US010670375B1

(12) United States Patent
Cannon

(10) Patent No.: US 10,670,375 B1
(45) Date of Patent: Jun. 2, 2020

(54) ADAPTIVE ARMOR SYSTEM WITH VARIABLE-ANGLE SUSPENDED ARMOR ELEMENTS

(71) Applicant: U.S. GOVERNMENT AS REPRESENTED BY THE SECRETARY OF THE UNITED STATES ARMY, Washington, DC (US)

(72) Inventor: Joseph P. Cannon, Lenox, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/102,858

(22) Filed: Aug. 14, 2018

Related U.S. Application Data

(60) Provisional application No. 62/684,346, filed on Jun. 13, 2018, provisional application No. 62/545,183, filed on Aug. 14, 2017.

(51) Int. Cl.
*F41H 5/013* (2006.01)
*F41H 5/007* (2006.01)
*F41H 7/04* (2006.01)

(52) U.S. Cl.
CPC ..... *F41H 5/013* (2013.01); *F41H 5/007* (2013.01); *F41H 7/044* (2013.01)

(58) Field of Classification Search
CPC . F41H 5/013; F41H 5/007; F41H 5/00; F41H 5/026; F41H 5/04; F41H 7/044; F41H 7/00; F41H 7/02; F41H 7/04
(Continued)

(56) References Cited

U.S. PATENT DOCUMENTS 661,201 A 11/1900 Wilding
746,722 A 12/1903 Mahler
(Continued)

FOREIGN PATENT DOCUMENTS

DE 3410962 A1 9/1985
EP 1517110 B1 1/2008
(Continued)

OTHER PUBLICATIONS

Cannon, Joseph; "Methodology for the System Integration of Adaptive Resilience"; Dissertation; Naval Postgraduate School; Sep. 2016.
(Continued)

*Primary Examiner* — John Cooper
(74) *Attorney, Agent, or Firm* — Gregory P. Gibson

(57) ABSTRACT

A novel adaptive armor system includes an array of armor elements, a hinge system, an actuator mechanism, and a tension support. The hinge system permits rotation of the armor elements about respective axes to change their orientation with respect to the vehicle body. The tension support is movably coupled between the actuator mechanism and the array and bears at least some of the weight of the armor elements in tension. The actuator mechanism moves the tension support (e.g., under the control of a controller) to change the angular orientation of at least some armor elements. Each armor element can include a tray that removably receives different ERA cassettes therein. An exemplary method includes detecting an incoming threat projectile, assessing at least one characteristic specific to the projectile, and changing the angular orientation of the array in a manner to defeat the incoming projectile. The invention provides threat adaptability while minimizing added weight and vehicle size.

20 Claims, 15 Drawing Sheets

(58) Field of Classification Search
USPC ..... 89/36.17, 36.01, 36.03, 36.07, 36.08, 89/36.09
See application file for complete search history.

(56) References Cited

U.S. PATENT DOCUMENTS 1,086,708 A 2/1914 Hoagland
1,119,200 A 12/1914 Stofa
1,166,460 A 1/1916 Hughes
1,223,536 A 4/1917 Travelstead
1,225,461 A 5/1917 McCarthy
1,376,304 A 4/1921 Casimir
1,410,820 A 3/1922 McMillan, Jr.
1,418,995 A 6/1922 Wallace
1,490,296 A 4/1924 Swanson
1,508,421 A 9/1924 Taegan
1,994,840 A 3/1935 Thoen
2,037,458 A 4/1936 Cornell et al.
2,182,461 A 12/1939 Yeakel
2,625,859 A 1/1953 Dandini
2,635,307 A 4/1953 Wood
2,723,214 A 11/1955 Meyer
2,774,306 A 12/1956 MacLeod
2,871,763 A 2/1959 Blomquist
2,977,885 A 4/1961 Perry, Jr. et al.
3,035,518 A 5/1962 Coursen
3,137,937 A 6/1964 Cowan et al.
3,169,478 A 2/1965 Schaaf
3,264,731 A 8/1966 Chudzik
3,416,051 A 12/1968 Pinto et al.
3,575,786 A 4/1971 Baker et al.
3,586,236 A 6/1971 Schaffler
3,590,685 A 7/1971 Lane
3,611,932 A 10/1971 Clator
3,765,299 A 10/1973 Pagano et al.
3,776,094 A 12/1973 Gilles et al.
3,813,281 A 5/1974 Burgess et al.
3,893,368 A 7/1975 Wales
3,983,832 A 10/1976 Kinder
4,009,638 A 3/1977 Ramseyer et al.
4,058,021 A 11/1977 Wood
4,177,732 A 12/1979 Steele
4,356,569 A 11/1982 Sullivan
4,358,984 A 11/1982 Winblad
4,364,300 A 12/1982 Pagano et al.
4,383,585 A 5/1983 Gaus
4,398,446 A 8/1983 Pagano et al.
4,524,674 A 6/1985 Gilvydis
4,526,828 A 7/1985 Fogt et al.
4,529,640 A 7/1985 Brown et al.
4,580,073 A 4/1986 Okumura et al.
4,662,288 A 5/1987 Hastings et al.
4,665,794 A 5/1987 Gerber et al.
4,741,244 A 5/1988 Rainer et al.
4,752,970 A 6/1988 Arakaki
4,842,182 A 6/1989 Szecket
5,012,721 A 5/1991 Medin et al.
5,025,707 A 6/1991 Gonzalez
5,070,764 A 12/1991 Shevach et al.
5,149,910 A 9/1992 McKee
5,183,119 A 2/1993 Wattenburg
5,293,806 A 3/1994 Gonzalez
5,402,704 A 4/1995 Donovan
5,431,082 A 7/1995 Zelverte et al.
5,435,195 A 7/1995 Meier
5,482,365 A 1/1996 Peterson et al.
5,533,781 A 7/1996 Williams
5,576,508 A * 11/1996 Korpi ..... F41H 5/013 89/36.01
5,577,432 A 11/1996 Becker et al.
5,637,824 A 6/1997 Benyami
5,738,925 A 4/1998 Chaput
5,747,721 A 5/1998 Speakes et al.
5,804,757 A 9/1998 Wynne
5,824,941 A 10/1998 Knapper
5,859,383 A 1/1999 Davison et al.
5,866,839 A 2/1999 Ohayon
5,915,449 A 6/1999 Schwartz
6,021,703 A 2/2000 Geiss et al.
6,080,493 A 6/2000 Kent
6,112,635 A 9/2000 Cohen
6,161,462 A 12/2000 Michaelson
6,240,997 B1 6/2001 Lee
6,345,563 B1 2/2002 Middlone et al.
6,374,897 B1 4/2002 Liu
6,460,945 B2 10/2002 Takeno et al.
6,588,705 B1 7/2003 Frank
6,622,608 B1 9/2003 Faul et al.
6,647,855 B1 * 11/2003 Christiansen ..... B64G 1/56 89/36.01
6,681,679 B2 1/2004 Vives et al.
6,782,793 B1 8/2004 Lloyd
6,880,445 B2 4/2005 Benyami et al.
7,059,236 B2 6/2006 Gonzalez
7,077,048 B1 7/2006 Anderson, Jr. et al.
7,080,587 B2 * 7/2006 Benyami ..... F41H 5/007 89/36.02
7,152,517 B1 12/2006 Ivey
7,261,945 B2 8/2007 Biermann et al.
7,299,736 B2 11/2007 Mayseless
7,424,845 B2 9/2008 Zank et al.
7,540,229 B2 6/2009 Seo et al.
7,597,040 B2 10/2009 Gabrys
7,603,939 B2 10/2009 Cohen
7,609,156 B2 10/2009 Mullen
7,631,600 B2 12/2009 O'Dwyer
7,698,984 B2 4/2010 LaBrash et al.
7,736,561 B2 6/2010 Tam et al.
7,827,900 B2 11/2010 Beach et al.
7,845,279 B2 * 12/2010 Keren ..... F41H 5/007 102/221
7,866,250 B2 1/2011 Farinella et al.
7,946,211 B1 5/2011 Winchester et al.
7,987,762 B2 8/2011 Joynt et al.
8,021,020 B2 9/2011 Costello et al.
8,033,208 B2 10/2011 Joynt et al.
8,037,804 B1 10/2011 Wahlquist
8,091,465 B2 * 1/2012 Ravid ..... F41H 5/0457 89/36.02
8,098,191 B1 1/2012 Pergande et al.
8,132,495 B2 3/2012 Joynt
8,151,685 B2 4/2012 Joynt
8,226,873 B1 7/2012 Martin et al.
8,272,311 B2 9/2012 Cannon
8,297,170 B2 10/2012 Diller et al.
8,316,752 B2 11/2012 Waddell, Jr. et al.
8,402,876 B2 3/2013 Cohen
8,424,443 B2 4/2013 Gonzalez
8,448,560 B1 5/2013 Gonzalez
8,450,593 B2 5/2013 Ierymenko et al.
8,453,553 B2 6/2013 Cannon
8,539,874 B1 * 9/2013 Grove ..... F41H 5/266 89/36.01
8,622,858 B2 1/2014 Huang
8,857,309 B2 * 10/2014 Wentzel ..... F41H 5/026 89/36.01
8,863,633 B2 10/2014 Gotie
9,335,140 B2 5/2016 Mitchell
9,568,283 B2 * 2/2017 Brill ..... F41H 5/007
9,885,543 B2 2/2018 Cannon
2003/0127122 A1 7/2003 Gower
2006/0065111 A1 3/2006 Henry
2006/0162538 A1 7/2006 Pfennig et al.
2006/0162539 A1 7/2006 Fucke et al.
2006/0202492 A1 9/2006 Barvosa-Carter et al.
2007/0039837 A1 2/2007 Hanina et al.
2009/0044694 A1 * 2/2009 Allor ..... F41H 5/013 89/36.08
2009/0107326 A1 4/2009 Benyami et al.
2009/0308238 A1 12/2009 Schwartz
2010/0043630 A1 2/2010 Sayre et al.
2010/0294124 A1 11/2010 Wentzel
2012/0011993 A1 1/2012 Malone et al.
2012/0097018 A1 4/2012 Schoenheit et al.

(56) References Cited

U.S. PATENT DOCUMENTS

| | | | | |
|---|---|---|---|---|
| 2012/0125187 | A1 | 5/2012 | Hunn | |
| 2012/0152101 | A1 | 6/2012 | Engleman et al. | |
| 2012/0186437 | A1 | 7/2012 | Cannon | |
| 2012/0204711 | A1* | 8/2012 | Engleman | F41H 5/007 89/36.02 |
| 2013/0014637 | A1 | 1/2013 | Cannon | |
| 2013/0087038 | A1 | 4/2013 | Diehl | |
| 2013/0186264 | A1 | 7/2013 | Errington et al. | |
| 2013/0200236 | A1 | 8/2013 | Wood | |
| 2013/0213210 | A1 | 8/2013 | Kellner et al. | |
| 2014/0260937 | A1 | 9/2014 | Whitaker | |
| 2016/0209181 | A1* | 7/2016 | Adrain | E06B 9/264 |
| 2017/0097211 | A1* | 4/2017 | Cannon | F41H 5/007 |

FOREIGN PATENT DOCUMENTS

| | | | |
|---|---|---|---|
| GB | 535638 | A | 4/1941 |
| WO | 2009126053 | A1 | 10/2009 |
| WO | 2011057628 | A1 | 5/2011 |
| WO | 2012117217 | A1 | 9/2012 |

OTHER PUBLICATIONS

Gurney Equations, 10 pages, Retrieved from Wikipedia.org, Jan. 24, 2014.

Explosion Welding, 3 pages, Retrieved from Wikipedia.org, Jan. 29, 2014.

U.S. Appl. No. 14/872,174, Office Action dated Feb. 23, 2017.

U.S. Appl. No. 14/872,174, Amendment/Response dated May 22, 2017.

U.S. Appl. No. 14/872,174, Final Office Action dated Jul. 19, 2017.

U.S. Appl. No. 14/872,174, Amendment/Response after Final Rejection dated Jul. 19, 2017.

Cannon, Joseph; "System Integration of Adaptive Resilience in Reactive Armor Systems"; 2017 NDIA Ground Vehicle Systems Engineering and Technology Symposium; Systems Engineering (SE) Technical Session; National Defense Industrial Association; Novi, MI; Aug. 8-10, 2017; 20 pages. (Available at http://gvsets.ndia-mich.org/documents/SE/2017/System%20Integration%20of%20Adaptive%20Resilience%20in%20Reactive%20Armor%20Systems.pdf).

U.S. Appl. No. 14/221,738, filed Mar. 21, 2014 by Cannon, Joseph P.; Specification, claims, drawings, and Filing Receipt. 33 pages, including coversheet. (Note: Application under Secrecy Order; the required IDS copy has been mailed to the attention of Licensing and Review.).

Cooper, Paul W.; Explosives Engineering, Chapter 27: Acceleration, Formation, and Flight of Fragments; New York; VCH Publ., 1996; Excerpt includes pp. 385-389; Additional coversheet applied; 6 pages total.

Burns, Bruce; Advanced Ballistics Science and Engineering; Army Research Laboratory; Aberdeen Proving Ground, MD; 2008; Excerpt includes book cover and pp. 444-445; Additional coversheet applied; 4 pages total.

Jackson, Scott; Architecting Resilient Systems: Accident Avoidance and Survival and Recovery from Disruptions; John Wiley & Sons; Hoboken, NJ; 2009; Excerpt includes pp. 162, 163 and 171; Additional coversheet applied; 4 pages total.

W.P. Walters and J.A. Zukas; Fundamentals of Shaped Charges; John Wiley & Sons; New York; 1989; Excerpt includes pp. 2, 49-50, and 338; Additional coversheet applied; 5 pages total.

Wikipedia; Reactive Armour; https://en.wikipedia.org/w/index.php?title=Reactive_armour&oldid=790070713; Jul. 11, 2017; 6 pages.

Wikipedia; Reactive Armour; https://en.wikipedia.org/w/index.php?title=Reactive_armour&oldid=834380926; Apr. 5, 2018; 6 pages.

Wikipedia; Reactive Armour; https://en.wikipedia.org/w/index.php?title=Reactive_armour&oldid=852765688; Jul. 31, 2018; 6 pages.

* cited by examiner

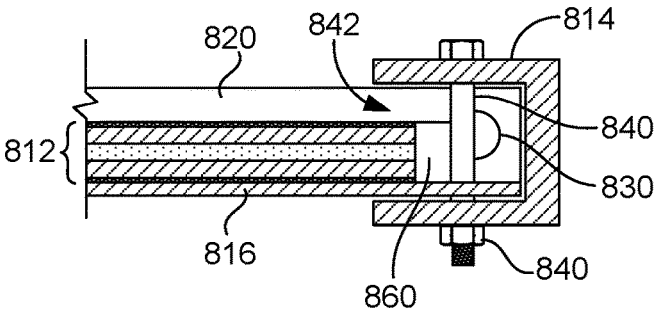
FIG. 8B
FIG. 8C
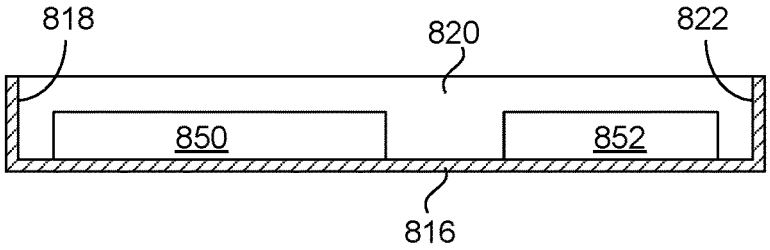
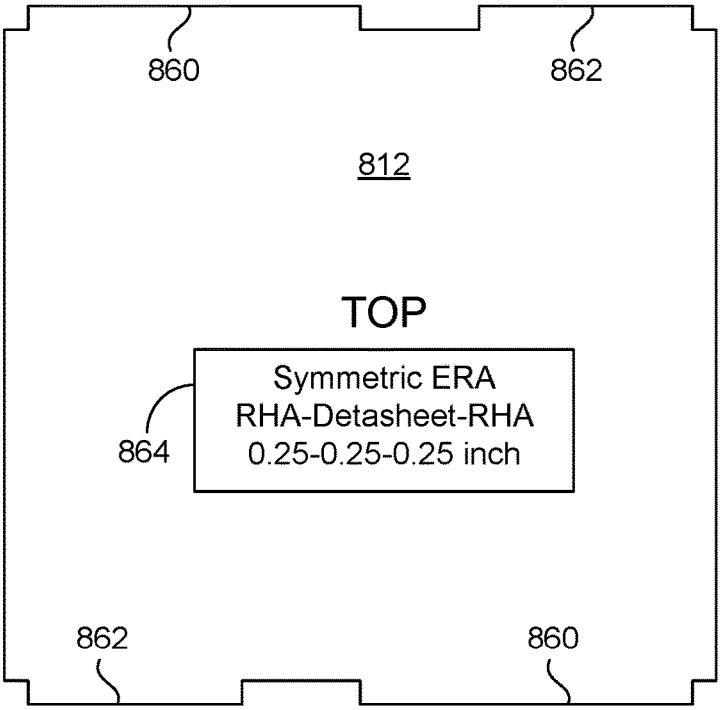
FIG. 8D

1100

Percentage of Time Coincidence

1104

1102

| | Armor Element Obliquity (Degrees) | | | | |
|---|---|---|---|---|---|
| | **15°** | **30°** | **45°** | **60°** | **75°** |
| **Symmetrical, EFP** | 20% | 43% | 74% | 128% | 277% |
| **Asymmetrical Front Plate, EFP** | 17% | 38% | 65% | 113% | 244% |
| **Asymmetrical Rear Plate, EFP** | 33% | 72% | 125% | 216% | 465% |
| **Symmetrical, SCJ** | 56% | 120% | 208% | 360% | 775% |
| **Asymmetrical Front Plate, SCJ** | 49% | 105% | 183% | 316% | 682% |
| **Asymmetrical Rear Plate, SCJ** | 93% | 201% | 349% | 604% | 1302% |

FIG. 11A

1150

Percentage of Mass Coincidence

| | Armor Element Obliquity (Degrees) | | | | |
|---|---|---|---|---|---|
| | **15°** | **30°** | **45°** | **60°** | **75°** |
| **Symmetrical, EFP** | 6% | 6% | 6% | 5% | 2% |
| **Asymmetrical, EFP** | 9% | 9% | 8% | 5% | 2% |
| **Symmetrical, SCJ** | 50% | 42% | 24% | 14% | 6% |
| **Asymmetrical, SCJ** | 105% | 50% | 28% | 16% | 8% |

FIG. 11B

ADAPTIVE ARMOR SYSTEM WITH VARIABLE-ANGLE SUSPENDED ARMOR ELEMENTS

CROSS-REFERENCE TO RELATED APPLICATIONS

This application claims the benefit of U.S. Provisional Patent Application Ser. No. 62/545,183, filed on Aug. 14, 2017 by the same inventor, which is incorporated by reference herein in its entirety. This application also claims the benefit of U.S. Provisional Patent Application Ser. No. 62/684,346, filed on Jun. 13, 2018 by the same inventor, which is incorporated by reference herein in its entirety.

GOVERNMENT INTEREST

The inventions described herein may be made, used, or licensed by or for the U.S. Government for U.S. Government purposes without payment of royalties to me.

BACKGROUND OF THE INVENTION

Field of the Invention

The present invention relates generally to armor for combat vehicles and, more particularly, to a mechanically adaptive armor system for defeating a range of different types of threats.

Description of the Background Art

Conventional passive and mechanically reactive armor structures and systems that are configured to defeat projectile and/or other threats have been implemented with varying degrees of success. Prior art vehicular armor is commonly fixed relative to the vehicle, and is statically unchangeable once produced and integrated with the vehicle.

Conventional fixed armor, however, generally presents deficiencies, compromises, and limitations in performance, which may be manifested as inadequate protection against threats, producing potential hazard to nearby individuals and/or equipment, excessive weight and size, and/or inability to transport vehicles equipped with the armor, etc. In many cases, conventional armors are ineffective for defeating some threats. As such, there is a desire for improved armor systems, particularly to defeat projectiles that utilize shaped charge jet (SCJ) or explosively formed penetrator (EFP) warheads of the types widely fielded in munitions for penetrating armor.

Explosive reactive armor (ERA) is a widely proliferated and relatively mass-efficient approach toward disrupting and reducing the deep penetration of SCJs and EFPs against conventional armor. There are numerous types of ERA, but most employ the same fundamental mechanism for threat defeat. This mechanism is a simple assembly of two sheets or plates of solid material laminated together by a thin sheet of explosive. This multi-layer construction is commonly known in the art as a cassette. The jet or slug of the shaped charge/EFP detonates the sheet of explosive when it strikes the ERA cassette, and the explosive detonation drives the two plates of solid material apart at a very high velocity. This opposing motion of the two sheets impinge on the length of the jet or slug(s) with armor material to defeat the threat.

The effectiveness of an ERA in defeating or reducing penetration by a projectile depends in great part on the angle at which a threat projectile strikes the ERA. Contemporary ERA systems employ fixed components, so that the effective angle (relative to the vehicle local x-y plane, for example) of the ERA must be determined well prior to the system being fielded. These contemporary systems must therefore be designed for maximum applicability across a range of expected or projected SCJ/EFP threats having a range of cone angles and diameters. Unfortunately, a single ERA design can, however, be optimized to protect against only a narrow portion of the SCJ/EFP spectrum. The fixed contemporary ERA designs are limited in their ability to adapt to emerging shape charge threats in operationally relevant time scales. This means that a simple change in the copper liner diameter, mass and cone angle of a shaped charge threat could render an ERA unable to mitigate its lethal penetration.

SUMMARY OF THE INVENTION

The present invention overcomes the problems associated with the prior art by providing an adaptive armor system that can actively adapt to and counteract a variety of incoming penetrator threats, particularly SCJs and EFPs. The invention provides this adaptability while also minimizing the weight added to the vehicle and facilitating good vehicle maneuverability, particularly in tight quarters. Additionally, the adaptive armor system facilitates rapid reconfiguration for different theatres of operation having different types of threats.

An adaptive armor system according to an embodiment of the invention includes at least one armor element having an inboard edge and an outboard edge opposite the inboard edge, a hinge system, an actuator mechanism, and a tension support. The hinge system is configured to couple to the at least one armor element, to position the inboard edge of the armor element external to a body of a vehicle and closer to the body than the outboard edge, and to permit rotation of the armor element about an axis, where the rotation changes an angular orientation of the armor element with respect to the body. The tension support is configured to movably couple between the actuator mechanism and the at least one armor element such that the tension support bears at least a portion of the weight of the armor element in tension. The actuator mechanism is configured to move the tension support to cause the armor element to rotate about the axis to change the armor elements angular orientation.

In a particular embodiment, the armor element includes an armor cassette and a tray configured to removably receive the armor cassette. In a more particular embodiment, the armor cassette comprises an explosive. In another more particular embodiment, the tray comprises a release mechanism configured to releasably retain the armor cassette in the tray. In still another more particular embodiment, the armor system includes a first armor cassette having a first layered configuration comprising explosive and a plurality of metal plates, a second armor cassette having a second layered configuration (different than the first) comprising explosive and a plurality of metal plates, and a third armor cassette having a third configuration different than the first and the second layered configurations. The tray is configured to selectively receive any one of the first, the second, and the third armor cassettes therein.

In yet another particular embodiment, at least a portion of the hinge system is configured to be affixed to an external surface of the vehicle body.

In still another particular embodiment, the armor system further includes a plurality of the armor elements. Additionally, the hinge system is configured to position each of the plurality of armor elements in an array external to the vehicle body such that respective inboard edges of the plurality of armor elements are closer to the body than respective outboard edges and, additionally, to permit each of the plurality of armor elements to rotate about a respective axis to change its angular orientation with respect to the body. Furthermore, the tension support is configured to bear at least a portion of the weight of each of the plurality of armor elements. In a more particular embodiment, the hinge system comprises at least one outboard linking member configured to pivotally couple the plurality of armor elements. Still more particularly, the hinge system can further comprises at least one inboard linking member configured to pivotally couple the plurality of armor elements at a location closer to the body of the vehicle than the at least one outboard linking member. In still an even more particular embodiment, the tension support comprises a flexible suspension member having a first end coupled to the outboard linking member and a second end coupled to the inboard linking member. Additionally, the actuator mechanism comprises a drive wheel configured to engage the flexible suspension member such that rotation of the drive wheel in a first direction simultaneously raises the outboard linking member and lowers the inboard linking member, and rotation of the drive wheel in a second direction simultaneously lowers the outboard linking member and raises the inboard linking member. In various embodiments, at least one of the outboard linking member and the inboard linking member can comprise an elongated flexible structure. In various embodiments, the tension support and at least one of the outboard and the inboard linking members can comprise a continuous flexible structure.

In yet another particular embodiment, the adaptive armor system further includes a controller operative to detect an incoming threat projectile, assess at least one characteristic specific to the threat projectile, and activate the actuator mechanism in response to the assessed characteristic of the threat projectile to change the angular orientation of the at least one armor element in a manner to defeat the threat projectile.

In still another particular embodiment, the adaptive armor system further comprises an extender mechanism configured to selectively move the at least one armor element and at least a portion of the hinge system away from the body of the vehicle.

A vehicle having an adaptive armor system is also disclosed. The vehicle includes a body, an actuator mechanism mounted to the body, an array of armor elements suspended from the body in a spaced relationship alongside an exterior surface of the body, and at least one tension support bearing at least a portion of the weight of each of the armor elements in tension. Each of the armor elements has an inboard edge, located closer to the exterior surface, and an outboard edge opposite the inboard edge and located farther from the exterior surface than the inboard edge. The tension support is coupled between the actuator mechanism and a position near the outboard edge of at least one of the armor elements. Additionally, movement of the actuator mechanism in a first direction causes corresponding movement of each of the armor elements of the array via the tension support and increases an angle between each of the armor elements and the body. Conversely, movement of the actuator mechanism in a second direction causes corresponding movement of each of the armor elements of the array via the tension support and decreases the angle between each of the armor elements and the body.

In a particular embodiment, the vehicle further comprises at least one outboard linking member pivotally coupled to each of the armor elements and at least one inboard linking member pivotally coupled to each of the armor elements closer to the body of the vehicle than the at least one outboard linking member. Additionally, movement of the actuator mechanism in the first direction raises the at least one outboard linking member and lowers the at least one inboard linking member. Conversely, movement of the actuator mechanism in the second direction lowers the at least one outboard linking member and raises the at least one inboard linking member. In a more particular embodiment, the at least one tension support comprises a flexible member having a first end and a second end where the first end and the second end are connected near the inboard and the outboard edges, respectively, of at least one of the armor elements of the array. Additionally, the actuator mechanism comprises a drive wheel engaging the flexible member and being selectively rotatable in the first direction and the second direction.

In another particular embodiment, the vehicle further includes at least one extender mechanism mounted to the body and configured to selectively move the array of armor elements away from the body.

An exemplary method is also disclosed for controlling an adaptive armor system having an array of armor elements positioned alongside an exterior surface of a vehicle and an actuator mechanism, where the angular orientation of each of the armor elements is adjustable with respect to the body in response to actuation of the actuator mechanism. The method includes the steps of detecting an incoming threat projectile, assessing at least one characteristic specific to the incoming threat projectile, and activating the actuator mechanism based on the at least one assessed characteristic to change the angular orientation of at least some of the armor elements of the array in a manner to defeat the incoming threat projectile.

In a particular example method, the step of assessing the at least one characteristic specific to the incoming threat projectile comprises determining a type of penetrator warhead of the incoming threat projectile, and the step of activating the actuator mechanism includes changing the angular orientation of at least some of the armor elements based on the type of penetrator warhead. In a more particular method, the step of activating the actuator mechanism further includes changing the angular orientation of at least some of the armor elements based on the type of penetrator warhead to affect the duration that the incoming threat projectile is acted upon by the array of armor elements. In another more particular method, the step of activating the actuator mechanism further includes changing the angular orientation of at least some of the armor elements based on the type of penetrator warhead to affect the amount of mass of the array of armor elements to be encountered by the incoming threat projectile.

In yet another particular method, the step of assessing at least one characteristic specific to the incoming threat projectile includes determining an attitude of the incoming threat projectile, and the step of activating the actuator mechanism in response to the assessed characteristic includes changing the angular orientation of the at least some of the armor elements of the array relative to the attitude.

Controllers for adaptive armor systems described herein are also disclosed. A controller according to an exemplary embodiment of the invention includes a processor, at least one actuator mechanism interface operative to provide control signals to drive at least one actuator mechanism, at least one sensor interface configured to receive sensor data associated with an incoming threat projectile, and memory storing code. The code includes a threat detection module, an assessment module, and an adaptive armor configuration module. The threat detection module is operative to detect the incoming threat projectile and to provide an indication of the incoming threat projectile, and the assessment module, responsive to the indication, is operative to make an assessment of at least one characteristic specific to the incoming threat projectile. The adaptive armor configuration module, responsive to the assessment, is operative to determine a desired angular orientation for at least some of the armor elements of the array, and provide one or more control signals to the at least actuator mechanism interface to cause associated actuator mechanism(s) to change the angular orientation of the at least some armor elements toward the desired angular orientation in a manner to defeat the incoming threat projectile.

BRIEF DESCRIPTION OF THE DRAWINGS

The present invention is described with respect to the following figures, wherein like reference numbers indicate substantially-similar elements:

FIG. 8B is a cross-sectional view taken along line A-A of FIG. 8A;

FIG. 8C is a cross-sectional view taken along line B-B of FIG. 8A;

FIG. 8D is a top view showing the armor cassette of FIG. 8A in greater detail;

FIG. 11A is a table showing exemplary armor-threat time coincidence data;

FIG. 11B is a table showing exemplary armor-threat mass coincidence data.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention. In other instances, particulars of well-known components and manufacturing practices (e.g., electrical power provisioning, metal forming techniques, etc.) have been omitted so as to avoid unnecessarily obscuring the present invention.

Figure 1:
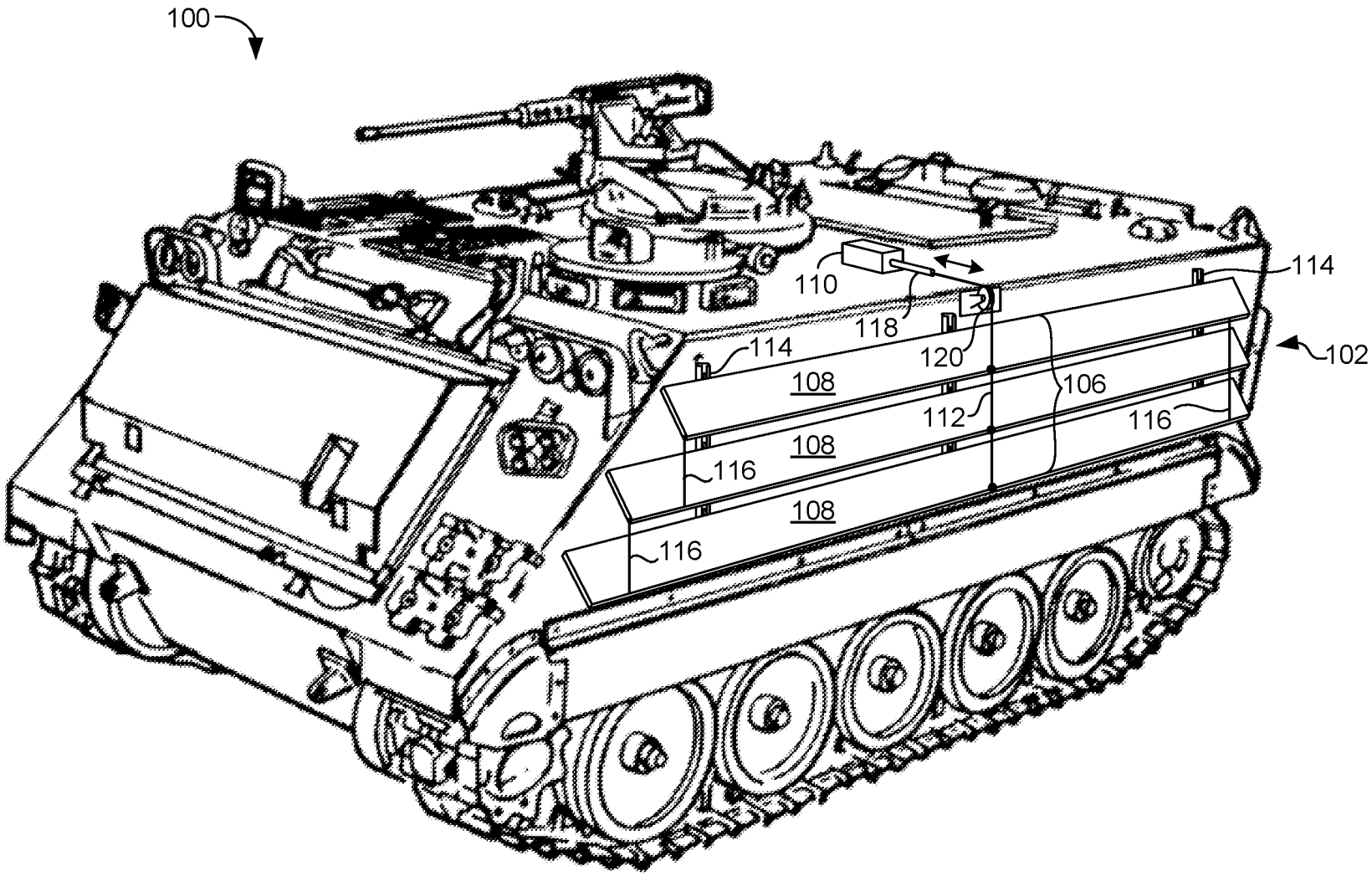
FIG. 1 is a perspective view of a representative combat vehicle equipped with an adaptive armor system according to an exemplary embodiment of the present invention.

FIG. 1 illustrates a representative combat vehicle 100 equipped with components of an adaptive armor system 102 according to an exemplary embodiment of the present invention. As shown, adaptive armor system 102 protects the left side of the vehicle body (hull) 104 from penetration by projectiles, particularly EFPs and/or SCJs. A similar adaptive armor system 102 (not shown) can be employed on the right side of the vehicle hull 104.

Adaptive armor system 102 includes an array 106 of armor elements 108, an actuator mechanism 110, a tension support 112, and a hinge system. Array 106 includes a plurality of vertically-spaced and generally parallel armor elements 108 extending generally longitudinally (relative to the vehicle) along the vehicle hull 104. Here, each of armor elements 108 is generally rectangular. The edge/side of each element 108 that is closest to the exterior surface of hull 104 when mounted thereto is referred to as "inboard," whereas the edge/side that is farthest from the exterior surface is referred to as "outboard." The front and rear edges/sides that connect the inboard and outboard edges are referred to as "lateral".

As will be discussed below, armor elements 108 can have various configurations and are readily adaptable to mission objectives. Armor elements 108 may advantageously comprise explosive reactive armor (ERA) tiles or cassettes. The elements may comprise any material or combination of materials (e.g., steel, aluminum, ceramic, composite, etc.) appropriate for the type of threat expected to be encountered. The use of interchangeable ERA cassettes is believed to be being particularly advantageous, because the adaptive armor system can be readily adapted to different SCJs and EFPs (e.g., those of different cone diameters, approach vectors, etc.).

The hinge system facilitates the coupling of armor elements 108 to vehicle 110 in array 106, positions the inboard edges of the armor elements external to the hull, and permits rotation of the armor elements 108 about their respective axes. The exemplary hinge system shown in FIG. 1 includes both inboard linking members (ILMs) 114 and outboard linking members (OLMs) 116. Each armor element 108 is pivotally coupled at or near its inboard edge to one or more of ILMs 114, which in this embodiment, are elongated rigid members (e.g., bars, rods, tubes, channels, etc.) mounted to the exterior surface of hull 104. More specifically, here ILMs 114 comprise vertically-oriented C-channels which pivotally engage (e.g., with a pass-through fastener, etc.) projections on the armor elements 108 that protrude inwardly into the C-channel. OLMs 116 connect armor elements 108 near their respective outboard edges and can comprise steel cables (as depicted) or other desirable lightweight tension members (e.g., a chain, rod, bar, tube, etc.). As will be described in subsequent figures, the hinge system, including ILMs and OLMs, can take on various forms.

ILMs 114 can be permanently secured to vehicle 100 such as by welding. Alternatively, they can be secured so as to removable/detachable (at a field and/or depot maintenance level), such as by an appropriate combination of bolts, pins, eyelets, slots, hooks, etc. This latter option allows the armor array 106 to be removed (in one or more unitary portions) from the vehicle if not required for a particular vehicle mission and/or environment, or for repair/replacement of the array and/or the other portions of the vehicle. The array 106 (or another array having different armor characteristics, as discussed above) can later be remounted to the original (or any other properly equipped) vehicle. The "real-world" (combat-effective) array can remain in-theatre and be swapped-out from outgoing to incoming vehicle, with "for training-only" arrays mounted to vehicles when in garrison.

Actuator mechanism 110 is mounted to vehicle 100 and is operatively connected with array 106 via tension support 112. In this embodiment, actuator mechanism 110 comprises a linear actuator that includes a push-pull rod 118 that moves tension support 112 inward and outward in the direction of the arrow, under the control of a control system (FIGS. 9 and 10) to facilitate rotation of armor elements 108 in unison about their respective axes (e.g., near their inboard edges, etc.). Such movement of tension support 112 positions each armor element 108 at a desired/optimum angular orientation with respect to hull 104 to counteract a detected or expected threat projectile. Tension support 112 comprises a flexible, lightweight drive member (e.g., cable, chain, etc.) that passes over a pulley 120 and is attached to one (e.g., the uppermost) or more (e.g., all) of armor elements 108 in array 106. (Tension support 112 is shown representationally connected to each armor element 108 in FIG. 1.) Thus, tension support 112 is coupled and configured to bear at least a portion of the weight of each armor elements 108 in array 106. Tension support 112 thus also function as an OLM 116.

Depending upon the length and total weight of a particular armor array 106, it may be desirable to employ more than one actuator mechanism 110 for that array in order to achieve a robust and rapidly responsive system. Actuator mechanism 110 can be powered by any appropriate means (electric, hydraulic, pneumatic, etc.) and should be a fast-acting device so that push-pull rod 118 can be extended/retracted through its full linear range quickly enough to allow adjustment of the plate array 106 to a desired angular position in response to an projectile approaching at high speed.

Figure 2:
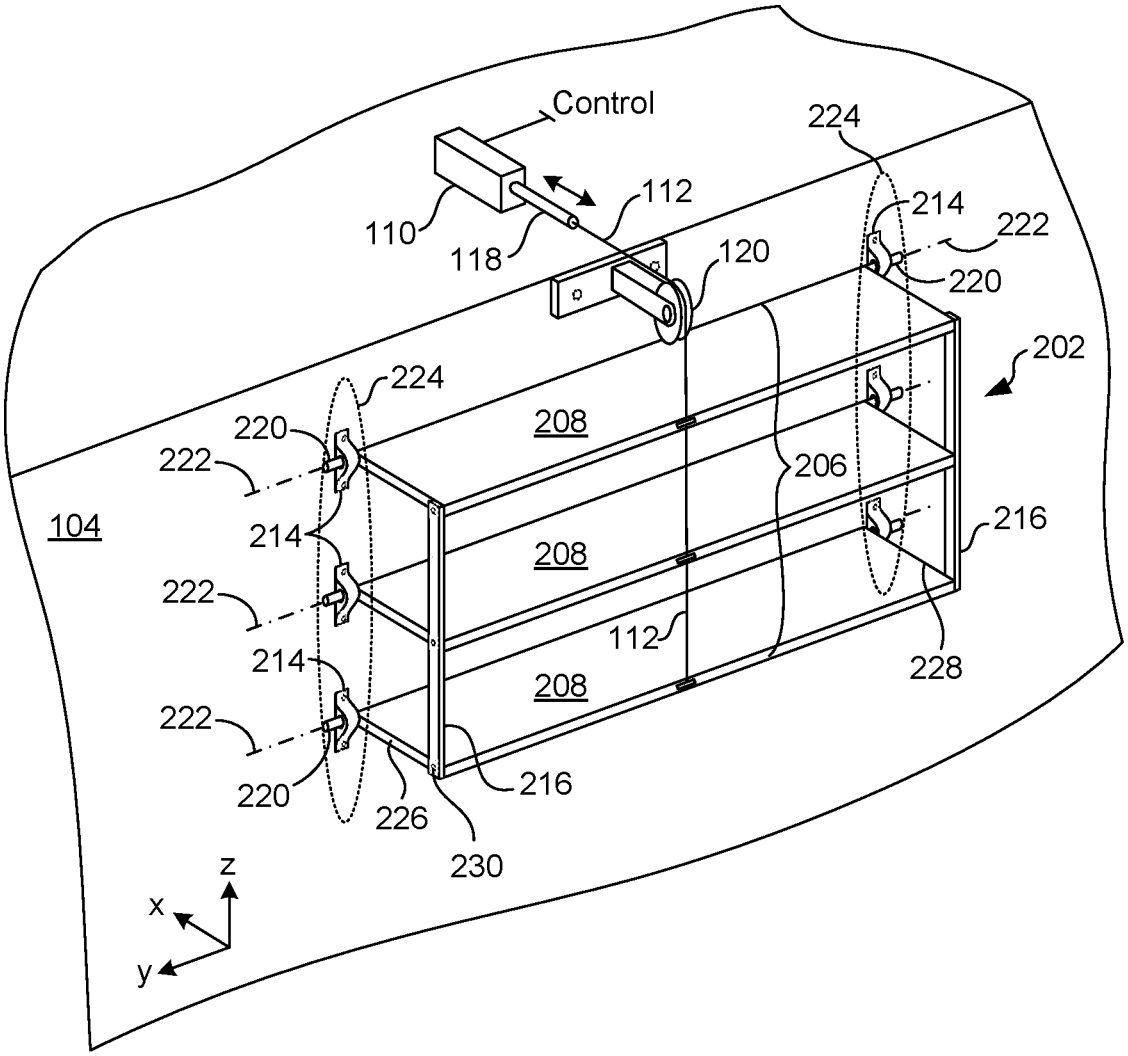
FIG. 2 is a perspective view showing an adaptive armor system according to another embodiment of the invention.

FIG. 2 depicts a representative portion of vehicle 100 having an adaptive armor system 202 according to another embodiment of the invention mounted thereto. Adaptive armor system 202 is similar to adaptive armor system 102 and includes a vertically-spaced array 206 of armor elements 208 pivotally mounted to an exterior of hull 104, however, armor elements 208 are longitudinally shorter than armor elements 108. Armor system 202 also includes an alternative hinge system comprising a plurality of inboard bearings 214 and rigid OLMs 216. Inboard bearings 214 engage pivot extensions 220 that extend outwardly from armor elements 208. In this example, extensions 220 comprise round metal (e.g., steel) posts that are affixed (e.g., pinned, threaded, welded etc.) near the inboard corners of armor elements 208. Pivot extensions 220 rotatably engage bearings 214 such that each of armor elements 208 can pivot in unison about respective axes 222 under the control of tension support 112. Sets 224 of inboard bearings 214 can still be considered inboard linking members, however, because they maintain the inboard edges of armor elements 208 in an evenly-spaced, arrayed fashion.

OLMs 216 connect the front lateral edges 226 and the rear lateral edges 228 of armor elements 208 via rotatable (e.g., pin, etc.) connections 230. Connections 230 allow armor elements 208 to rotate relative to the OLMs 216, while still enabling the OLMs 216 to carry the load of armor elements 208 in tension. Because the armor elements 208 are attached to the OLMs 216 by rotating, hinge-like connections 230, OLMs 216 maintain a generally vertical orientation (relative to the vehicle z-axis) as the armor elements 208 rotate about their axes 222.

The armor elements 208 and their respective adjustment axes 222 are shown to extend generally parallel to the longitudinal axis (y-axis), but this alignment may vary somewhat in a specific vehicle application, depending upon the contours and configuration of the vehicle surface to be protected. Vehicle configuration may also be a factor in determining whether a single, long array (e.g., array 106, etc.) is used over the protected portion of the vehicle, or whether it is more practical to utilize a number of shorter-length arrays (e.g., array 206, etc.) that may be actuated separately or in unison.

Actuator mechanism 110 of FIG. 2 is the same as FIG. 1 and is operatively connected (e.g., via clamps, pins, fasteners, etc.) with tension support 112, which as above, can comprise an outboard linking member. Here, tension support 112 is connected to each armor element 208 in the embodiment of FIG. 2, but alternatively could be directly connected to only the uppermost armor element 208. Tension member 112 is operable to alternatively raise and lower the OLMs 216 relative to the inboard bearings (ILMs) 214, thereby causing the armor elements 208 to rotate about their respective adjustment axes 222.

Figure 3:
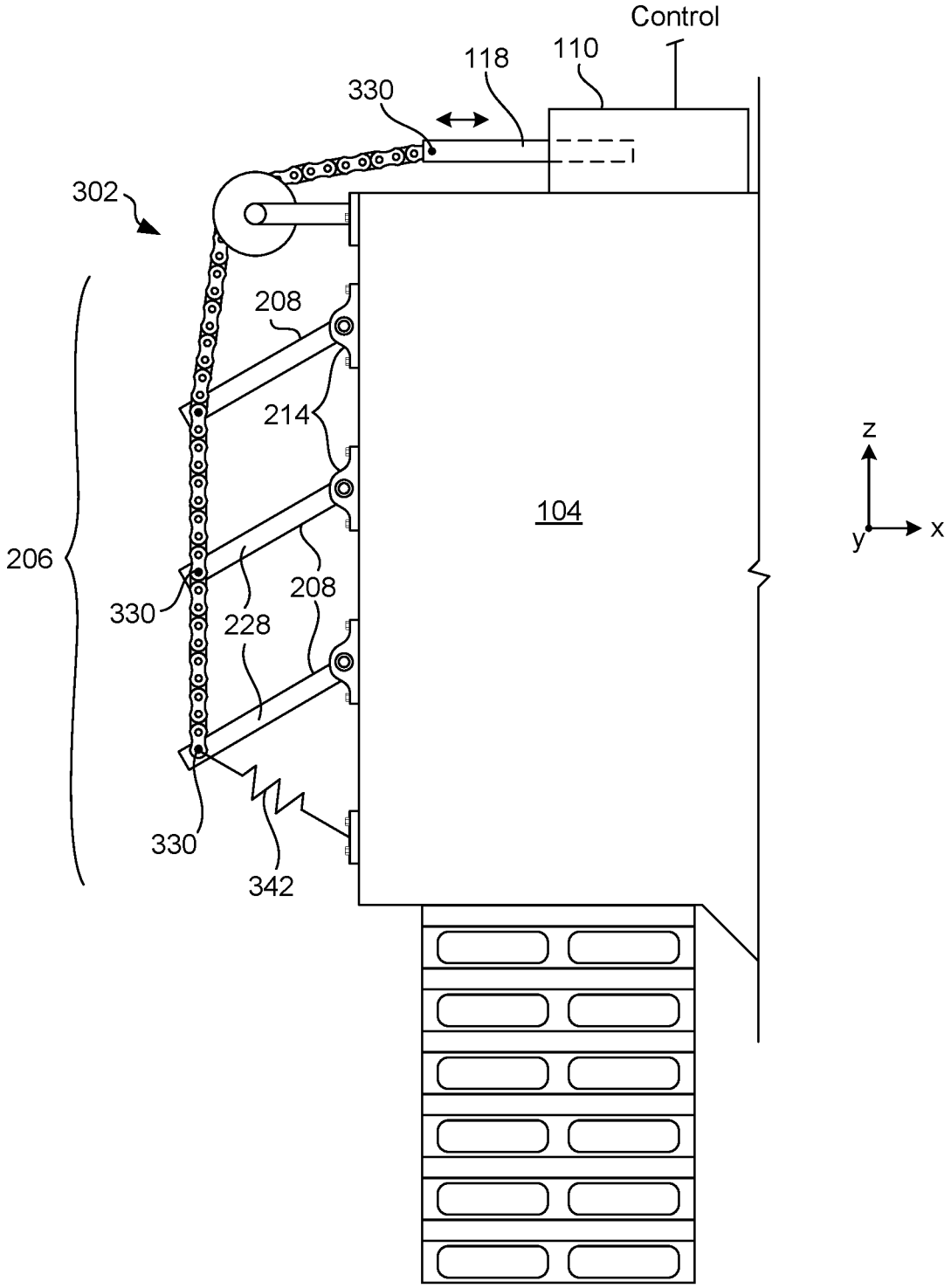
FIG. 3 is a schematic view showing an adaptive armor system according to yet another embodiment of the present invention.

FIG. 3 is a rear view showing vehicle 100 having an adaptive armor system 302 according to yet another embodiment of the present invention mounted thereon. Adaptive armor system 302 is similar to adaptive armor system 202, except that a chain 312 (e.g., a #40 chain, etc.) is utilized as a tension support and is pivotally attached to rear lateral edges 228 of armor elements 208 via respective pin connections 330 passed through links of chain 312. In this embodiment, actuator mechanism 110 and pulley 120 have also been relocated on hull 104 to align the path of chain 312 with rear lateral edges 228. Another iteration of actuator mechanism 110, pulley 120, and chain 312 can optionally be incorporated to drive the front lateral edges 226 of armor elements 208. As still another option, chain 312 can be pinned (e.g., to the outboard edges) of armor elements 208 in between front and rear lateral edges 226 and 228 if desired. Indeed, many different connection configurations can be employed.

It should be further noted that chain 312 bears the weight of at least a portion of each armor element 208 in tension and also functions as an outboard linking member 316. Thus, chain 312 forms a continuous tension member and OLM. If desired, a sprocket can be used as pulley 120 to more positively engage chain and guide its movement.

FIG. 3 also shows that a bias element 342 (e.g., a tension spring, etc.) may be provided to exert a downward force on the lowermost armor element 208 of array 206 near its outboard edge and/or via one or more of the OLMs 316. This downward force can be desirable to ensure that any friction between the moving components of the armor array does not impede rapid movement of the array. Bias element 342 can also advantageously bias array 206 toward a default position for faster return to that position and/or to prevent jitter. One or more such bias elements may be used as desired in the various embodiments described herein.

Figure 4B:
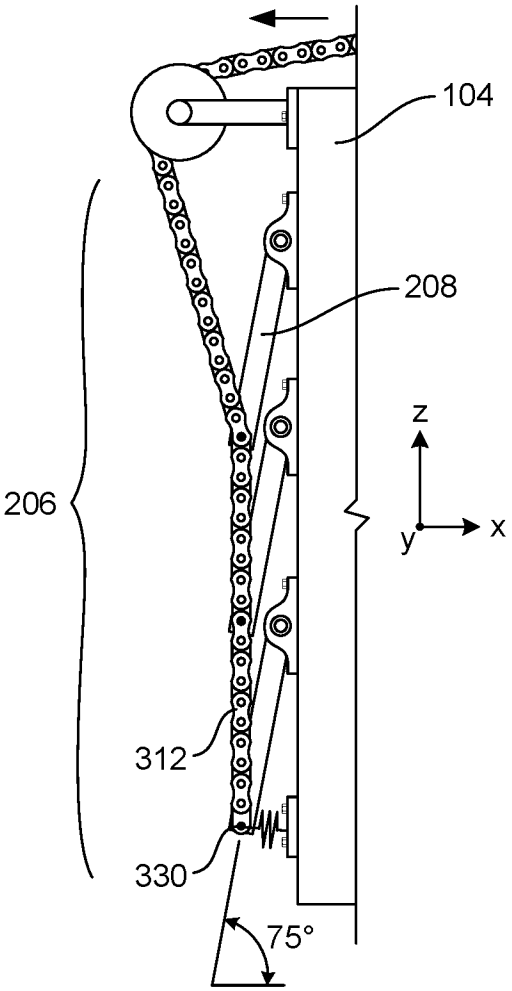
FIG. 4B shows the armor elements of the adaptive armor system of FIG. 3 at a second angular orientation.
Figure 4A:
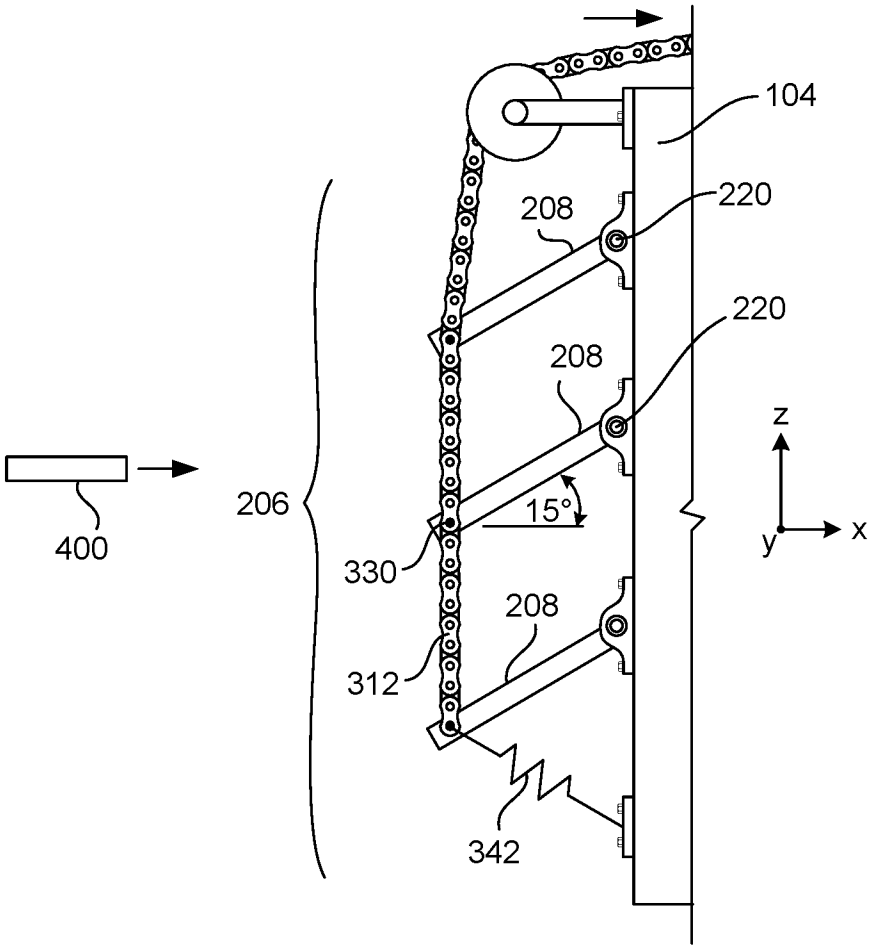
FIG. 4A shows the armor elements of the adaptive armor system of FIG. 3 at a first angular orientation.

FIGS. 4A and 4B further show how each armor element 208 of the armor array 206 of FIG. 3 is movable through a large angular range, which in the depicted embodiment is from approximately 15° to 75° with respect to an x-y plane (e.g., passing through a hinge connection 330). (This range corresponds to a range of 105° to 165° with respect to a y-z plane passing through pivot extensions 220.) This range of motion is by way of example only and, for an operational system, will be determined by many factors. Among those factors are: 1) the nature and configuration (e.g., shaped charge diameter, etc.) of the warhead(s) the invention system is intended to defeat; and 2) the expected or detected angle-of-approach (attitude) of such projectiles 400 (e.g., relative to the vehicle local x-y plane, etc.). The above factors are considered, because some projectiles 400 might be fired from a high or low position relative to vehicle 100, some warheads might fire a slug or jet at an angle (e.g., downwardly) relative to its incoming attitude, etc. It may also be desirable for array 206 to be movable to a "fully stowed" position in which the armor elements 208 lay as flat against the surface of the vehicle as possible. Such a condition can better allow vehicle 100 to move through narrow urban terrain and/or to make it more easily transported by another vehicle (aircraft, ship, or land vehicle).

It should be understood that armor elements depicted in other embodiments of the invention are likewise movable through ranges similar to armor array 206 shown in FIGS. 4A-4B. Additionally, it should also be understood that the armor elements of arrays according to the present invention may extend upwardly away from the vehicle (rather than, or in addition to, downwardly, as shown) to provide further adaptability to threats and a wider range of warhead attitudes. Similarly, such adaptability can enable the use of armor elements in different ways according to the elements' construction configurations, as will be described later.

Figure 5A:
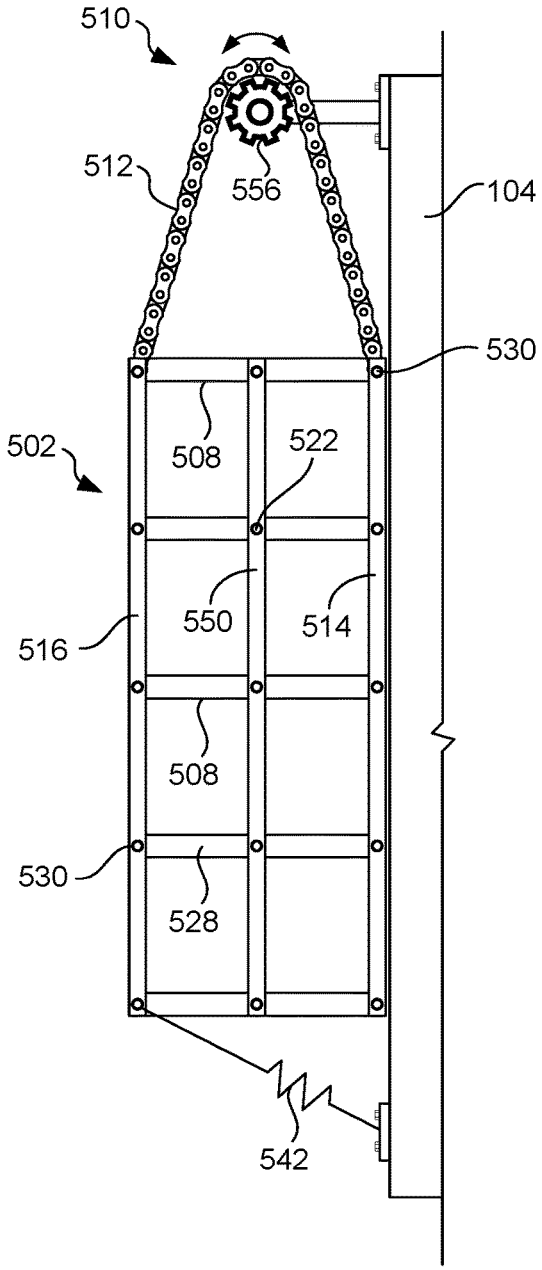
FIG. 5A is a schematic view showing a first side of an adaptive armor system according to still another embodiment of the present invention.
Figure 5B:
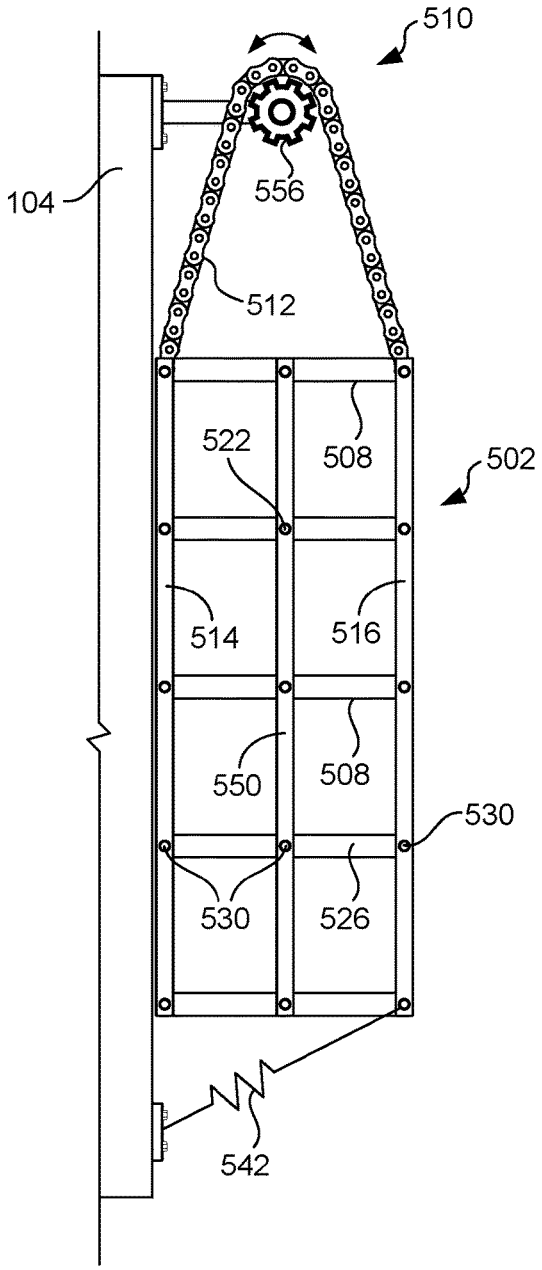
FIG. 5B is a schematic view showing a second side of the armor system of FIG. 5A.
Figure 5C:
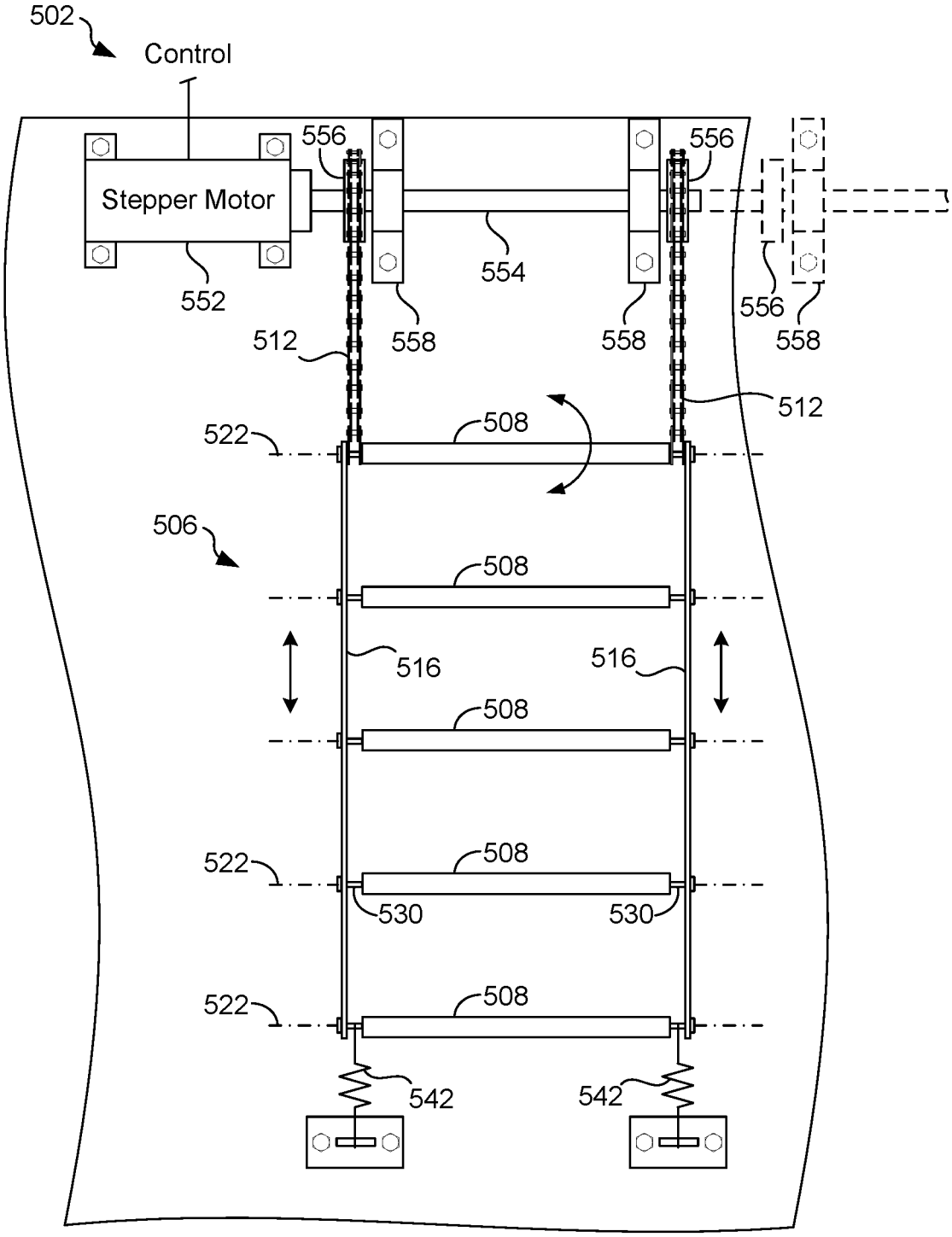
FIG. 5C is a schematic view showing a third side of the armor system of FIG. 5A.

FIGS. 5A-5C show an adaptive armor system 502 according to still another embodiment of the present invention. FIG. 5A is a view looking toward the rear side of armor system 502, FIG. 5B is a view looking toward the front side of armor system 502, and FIG. 5C is a view looking toward the outboard side of armor system 502.

The embodiment shown in FIGS. 5A-5C differs from the previously-described embodiments in several respects. First, the hinge system of armor system 502 comprises rigid, bar-like ILMs 514 and OLMs 516, which are rotationally coupled to each of the plurality of armor elements 508 via hinge connections 530 (e.g., pins, etc.). The hinge system also includes front and rear central linking members (CLMs) 550, which are rotatably coupled with the armor elements 508 via hinge connections 530 at the respective adjustment axes 522 of armor elements 508. CLMs 550 are also rigid, bar-like elements in this embodiment. Using rigid, bar-like elements for ILMs 514, OLMs 516, and CLMs 550 advantageously provide a stabilizing effect on the interconnected armor elements 508 when the armor system 502 is suspended adjacent the hull 104. Nevertheless, such rigid bar-like elements may be relatively light-weight, because the only significant loads to which they are subjected are tension loads due to the weight of the armor elements. Bias elements 542 are also provided to overcome friction of the pivoting components of armor array 506 and to urge the armor system 502, which is otherwise "hanging" vertically, toward vehicle hull 104.

Second, the armor elements 508, the ILMs 514, the OLMs 516, and the CLMs 550 are suspended from the actuator mechanism 510 via a plurality of tension supports 512. A first end of each tension support 512 is coupled near an outboard edge of the uppermost armor element 508, whereas a second end of each tension support 512 is coupled near an inboard edge of the uppermost armor element 508. Optionally, tension support can continue down the array near the inboard and/or outboard sides (similar to chain 312 in FIG. 4) of armor elements 508 to further function as ILM 514 and/or OLM 516 simultaneously.

Third, actuator mechanism 510 comprises a rotary actuator (instead of a linear actuator 110) that is operatively connected with the armor array 506 via flexible drive member 512. Rotation of rotary actuator 510 moves the inboard and outboard edges of the array 506 simultaneously and opposite to one another about adjustment axes 522 to change the angular orientation of armor elements 508 relative to hull 104. As shown in FIG. 5C, rotary actuator 510 comprises a rotation device 552 having a shaft 554 coupled to a plurality of drive sprockets 556 and supported by one or more bearings 558. As shown, rotation device 552 comprises a synchronous stepper motor affixed to the exterior of hull 104 and selectively turns drive sprockets 556 in forward and reverse directions via shaft 554. Shaft 554 of actuator 510 can optionally be connected to actuate each of a plurality of adjacent armor arrays 506 as indicated in dash in FIG. 5C.

Coupling flexible drive members 512 between ILMs 514 and OLMs 516 and positioning adjustment axes between ILMs 514 and ILMs 516 provides particular advantages. For example, the above features allow a given change in angular position of the armor elements 508 to be achieved by moving the outboard edges of the armor elements 508 a vertical distance of only half the distance that the outboard edges must move in the configurations of prior embodiments. This one-half reduction results from the fact that the inboard edges of armor elements 508 simultaneously move upward a distance equal to the distance that the outboard edges move downward, and vice-versa. This reduction in the travel distance can contribute to the ability to rotate the plates 508 to the desired/optimum angle more quickly, and therefore reduce the reaction time of the overall system after threat detection. Additionally, synchronous stepper motors, such as rotation device 552, are fast-acting and precisely controllable for rapid response.

Figure 6A:
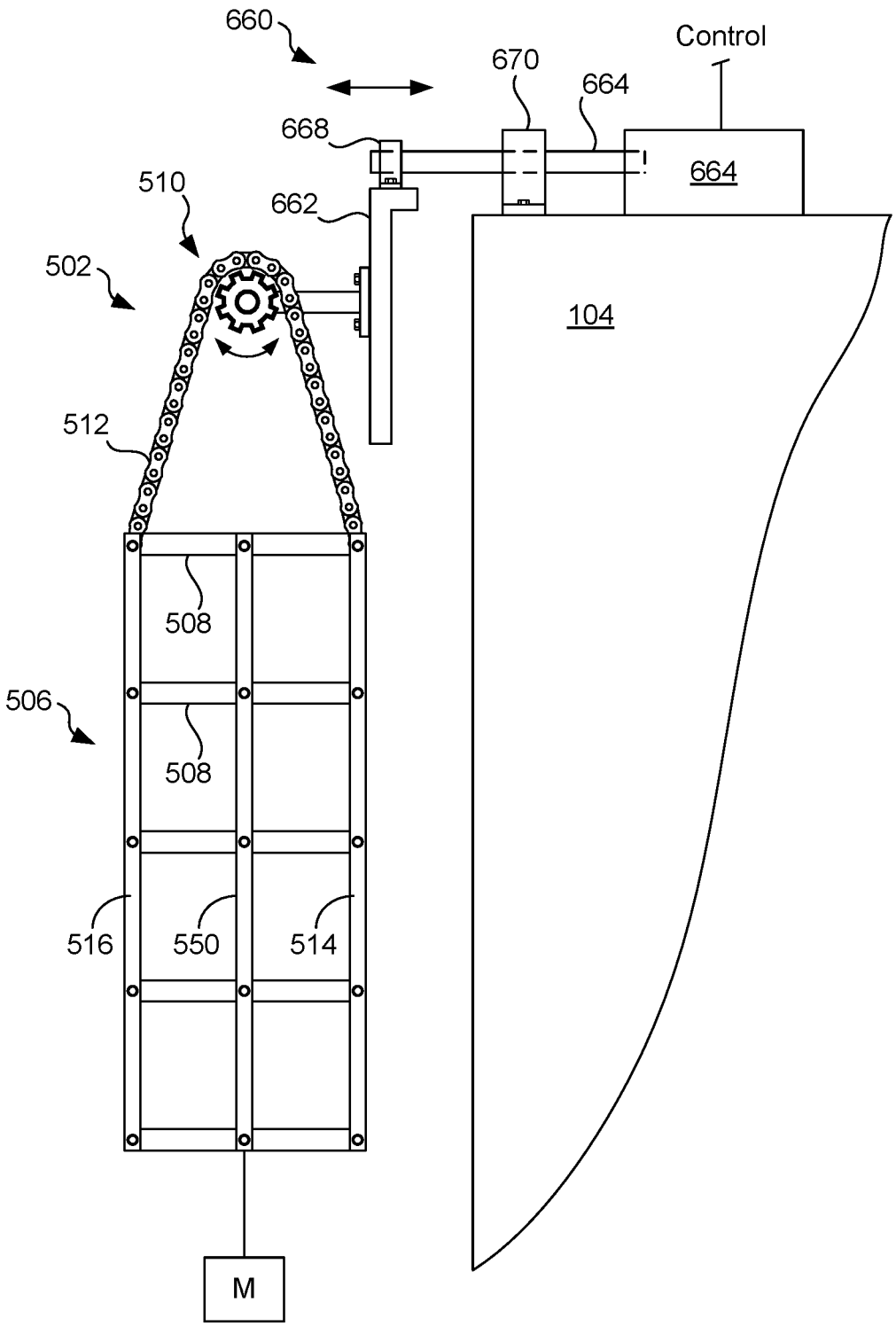
FIG. 6A is a schematic view showing an adaptive armor system according to yet another embodiment of the present invention.

FIG. 6A schematically depicts adaptive armor system 502 mounted to vehicle hull 104 via an extender mechanism 660. Extender mechanism 660 is configured to selectively move adaptive armor system 502 away from vehicle hull 104. As shown, the components of one or more armor system(s) 502 of FIGS. 5A-5C are mounted on an extension surface 662 (e.g., a metal plate). Thus, the actuator mechanism 510 comprises a rotary actuator, but utilizing a linear actuator (FIGS. 1-4) to rotate armor array 506 is also within the scope of the embodiments of FIGS. 6A and 6B. It should also be noted that some of the components of armor system 502 (e.g., stepper motor 552) are omitted, so as not to unnecessarily obscure the features of FIGS. 6A and 6B.

Extender mechanism 660 also includes a linear actuator 664 mounted on hull 104. Extension surface 662 is selectively movable away from and toward an exterior surface of hull 104 under the control of linear actuator 664. More specifically, extension surface 604 is mounted to a distal end of a ram 664 of linear actuator 664 by a bracket 668. Ram 664 is further supported by a high-load linear bearing 670 that provides a robust, sliding connection with ram 664 for supporting extension surface 662 and the one or more adaptive armor systems 502 coupled thereto in extended and retracted positions. Responsive to signals from a controller (FIGS. 9-10), actuator 664 is operative to selectively extend and retract ram 664. A mass "M" can optionally be provided below the lowermost armor element 508 of armor array 506 to resist swinging motion of the array 506 when ram 664 is in the extended position shown and/or otherwise in motion.

Figure 6B:
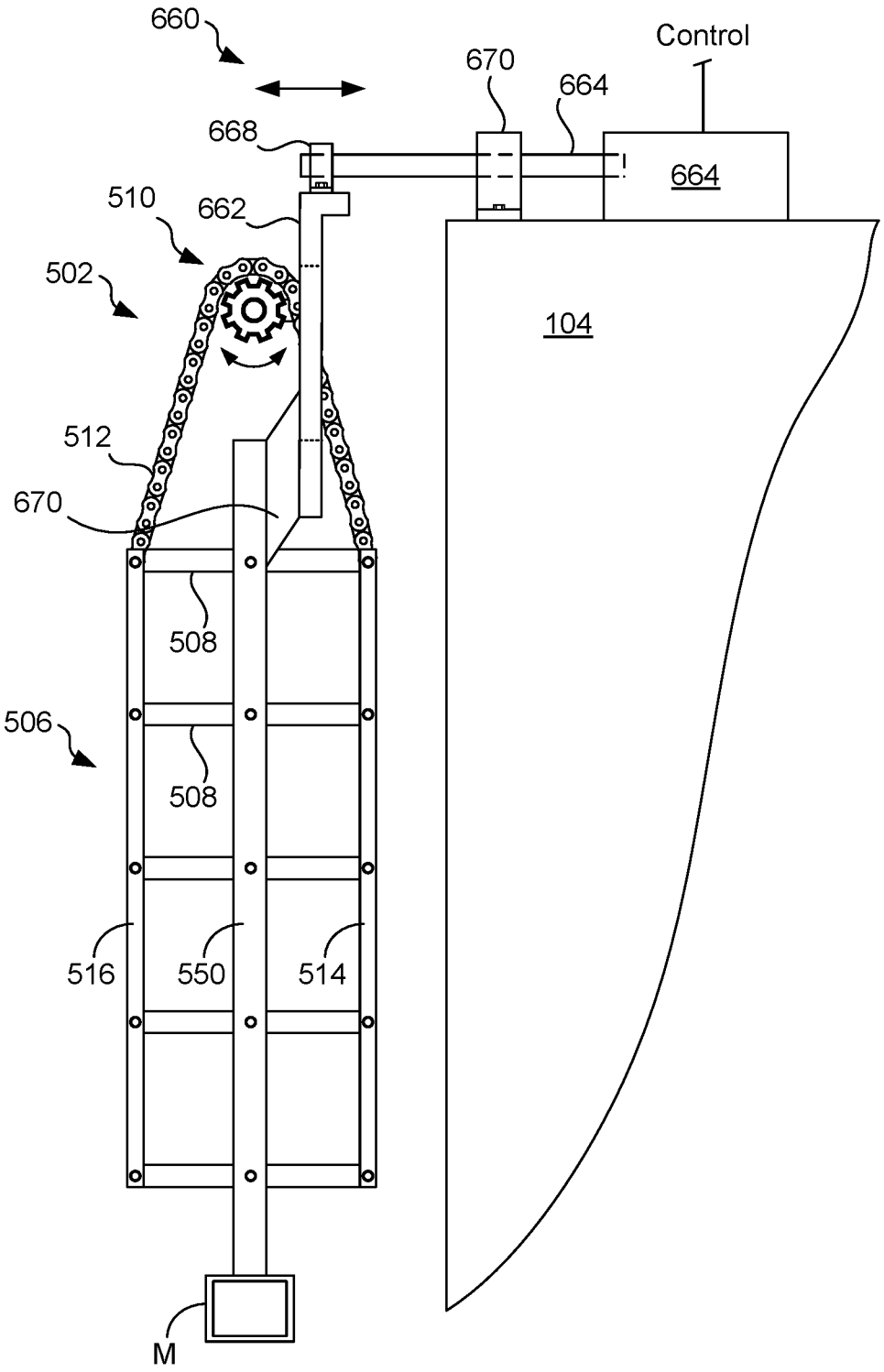
FIG. 6B is a schematic view showing an adaptive armor system according to still another embodiment of the present invention.

The adaptive armor system arrangement shown in FIG. 6A can be modified in several ways to make the armor system more compact and stable, such as shown in FIG. 6B. As one example, relief(s) can be formed in extension surface 662 such that chains 512 can pass therethrough. In this manner, extension surface 612 can be moved closer to the axis of rotation of drive sprockets 556. Thus, when array 506 is in a collapsed state, ram 664 can be retracted and array 506 can be stowed closely and compactly against vehicle hull 104. This improves vehicle mobility when operating in tight (e.g., urban) areas and for transport. As another example, extension surface 612 and one or both CLMs 550 can be integrated as a single structure as shown. Accordingly, CLM(s) 550 is/are stabilized via extension surface 662, and array 506 resists twisting and swinging toward hull 104 when in the extended position. Additionally, any desirable mass "M" can be incorporated integrally with member 670, for example, as a tubular extension attached (e.g., welded) thereto.

The systems of FIGS. 6A and 6B provide the advantage that the armor array(s) 506 is/are movable to increase or decrease the horizontal distance between the armor array(s) 506 and the protected surface of the vehicle hull 104. Changing this distance will have the effect of also changing the distance from the protected surface at which a warhead is expected to detonate.

Several notable features of the invention are apparent from the forgoing embodiments. First, the ILMs and OLMs combine to maintain the armor elements in a generally parallel and vertically-spaced relationship to one another throughout the range of angular adjustment of the armor array. Second, significant portions, if not all, of the total weight of the armor array is borne by the tension supports, OLMs, and/or ILMs. If such tension-bearing members are flexible, the tension keeps those flexible members taut. Moreover, just as a cable-suspension bridge is lighter than a truss bridge of equal span and weight-bearing capacity, the use of a suspension-type tension members for some or all of the mass/weight of the armor array yields a reduction in the total mass of the system when compared to rigidly-supported active armor system. This overall weight reduction yields a commensurate reductions in both the power needed to move the array and the activation time required to move the array to the optimum position for a detected threat. Decreasing the activation time is a significant advantage to defeating the threat and improving survivability of the vehicle. Weight reduction also improves operating dynamics of vehicle 100.

It should again be emphasized that the OLMs described herein can have load-carrying capacity only in tension, because each of the armor elements is suspended from the elements above it in the array. Moreover, each OLM can comprise a single, continuous element that connects with every armor element in the array, or can comprise multiple discrete and shorter elements that connect two (or more) adjacent armor elements. Similarly, shorter linking members (inboard or outboard) can be used to connect the bottom of an upper armor element to the top of a next lower armor element, etc. These and other modifications will be evident in view of this disclosure.

FIGS. 7A-7D show cross-sectional views of exemplary tri-plate configurations for the armor elements discussed herein. Such armor elements can be directly coupled to ILMs, OLMs, and/or CLMs as discussed previously herein, for example, by configuring the tri-plate armor elements with the appropriate hinge means (e.g., pins, pivot extensions, fasteners, hinges, etc.). Alternatively, as will be discussed in subsequent figures, the different tri-plate configurations can be embodied in interchangeable "cassettes" that can be selected and inserted into a plurality of trays arranged in an array as desired. In such a case, a tray and a cassette can be considered an armor element.

Figure 7A:
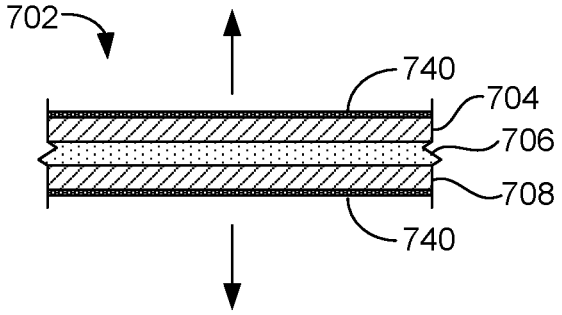
FIG. 7A is a cross-sectional view showing an exemplary tri-plate configuration of an armor element.

FIG. 7A is a cross-section of a tri-plate 702 having a symmetric configuration. More specifically, tri-plate 702 includes a first layer 704 comprising rolled-homogenous armor (RHA) (e.g., a steel layer), a second layer 706 comprising explosive (e.g., Detasheet at 0.25 inches thick), and a third layer 706 comprising RHA. Tri-plate 702 is symmetric because the thicknesses of layers 704 and 708 are the same (e.g., 0.25 inches). Thus, when tri-plate 702 is impacted by a projectile and explodes, RHA layers 704 and 708 will be blown outward in opposite directions (as indicated by the arrows) at approximately the same velocities.

Figure 7B:
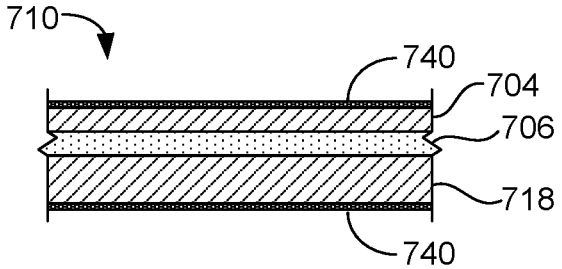
FIG. 7B is a cross-sectional view showing another exemplary tri-plate configuration of an armor element.

FIG. 7B shows a tri-plate 710 having a first layer 704 of RHA (0.25 inches), a second layer 706 of explosive (0.25 inches), and third layer 718 of RHA (0.50 inches). First and second layers 704 and 706 are the same as layers in FIG. 7B. However, third layer 718 has twice the thickness of RHA layer 708. Accordingly, when tri-plate 710 is impacted by a projectile and explodes, RHA layers 704 and 718 will be blown outward in opposite directions as in FIG. 7A. However, the RHA layer 718 will be moving outward at a slower velocity (e.g., approximately half) than that of RHA layer 708 (FIG. 7A). Although not shown, an asymmetric tri-plate can alternatively have a top RHA layer that is thicker than the bottom RHA layer.

Figure 7C:
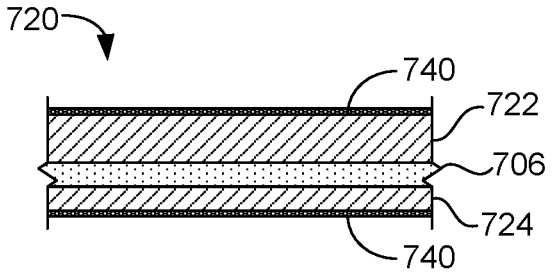
FIG. 7C is a cross-sectional view showing still another exemplary tri-plate configuration of an armor element.

FIG. 7C shows another symmetric tri-plate 720 having a first layer 722 of RHA, a second layer 706 of explosive, and a third layer 724 of RHA. Because layers 722 and 724 are the same thickness (0.50 inches), they will move outward at approximately the same velocities when armor element 720 explodes, but at slower velocities than layers 704 and 708 of tri-plate 702.

In FIGS. 7A-7C, plate thicknesses can be varied to yield desirable outward velocities of the RHA layers based on the type of projectile they are intended to counteract. The thickness of the explosive layer can similarly be varied to increase or decrease outward RHA velocities.

Figure 7D:
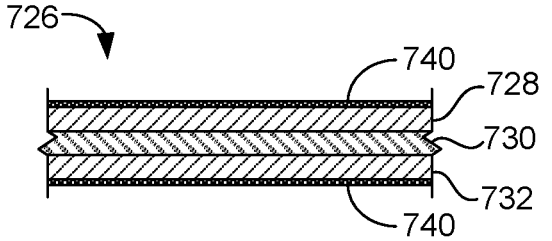
FIG. 7D is a cross-sectional view showing yet another exemplary tri-plate configuration of an armor element.

FIG. 7D shows a tri-plate 726 that is made up of three RHA layers 728, 730, and 732 having the same thickness (e.g., 0.25 inches, etc.). Tri-plate 726 is not explosive, but enables the adaptive armor systems discussed herein to be configured for missions where armor penetrating projectiles are not of concern or for training where explosives are not desirable.

Finally, FIGS. 7A-7D show that the tri-plates 702, 710, 720, and 726 can be encapsulated in polymer or other protective material layer(s) 740, such as a rugged truck bed liner material. Thereafter, the armor elements can be painted for camouflage, UV resistance, indicia etc.

Figure 8A:
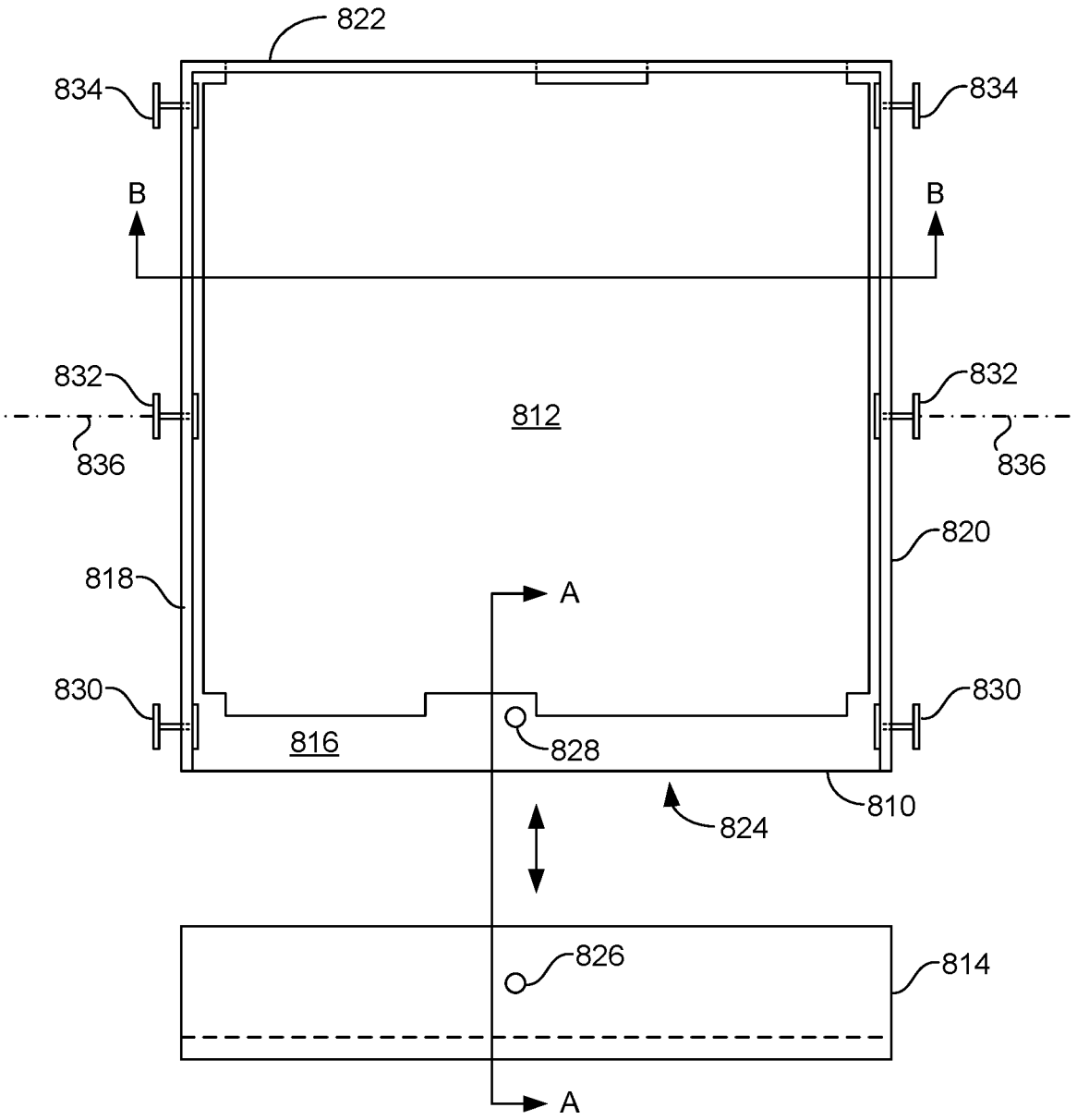
FIG. 8A is a top, partially-exploded view showing an armor element according another embodiment of the present invention.

FIG. 8A is a top view showing an armor element 808 according to another embodiment of the present invention. In this embodiment, armor element 808 comprises a tray 810, a removable armor cassette 812, and an endcap 814. Tray 810 includes a generally flat bottom surface 816, a left sidewall 818, a right sidewall 820, and an inboard wall 822. Sidewalls 818 and 820 and back wall 822 are continuously formed and extend perpendicularly from bottom surface 816. In other embodiments, walls 818, 820 and 822 can be separated. Tray 810 is configured to removably receive armor cassette 812 therein such that armor cassette 812 lays flat on bottom surface 816. The outboard side 824 (bottom in this view) of tray 810 is unobstructed to facilitate easy insertion and removal of armor cassette 812 in tray 810. Endcap 814 slides over the outboard side 824 of tray 810 and functions to retain armor cassette 812 in position in tray 810. Endcap 814 and tray 810 define respective complementary apertures 826 and 828 that facilitate the passage of a fastener therethrough to affix endcap 814 to tray 810. Only one fastener is used in the present example, however, in other embodiments multiple fasteners and sets of associated apertures can be employed.

FIG. 8A also shows that each of sidewalls 818 and 820 includes an outboard hinge element 830, a central hinge element 832, and an inboard hinge element 834. Here, hinge elements 830, 832, and 834 comprise pins disposed through sidewalls 818 and 820, although other hinge elements (e.g., posts welded to tray, bolts and nuts, etc.) can be used. Outboard hinge elements 830 connect opposite sides of tray 810 to respective OLMs (e.g., OLMs 516, etc.), whereas inboard hinge elements 834 connect opposite sides of tray 810 to respective ILMs (e.g., ILMs 514, etc.). Central hinge elements 832 connect opposite sides of tray to respective CLMs (e.g., CLMs 550, etc.). Additionally, in embodiments where the ILMs and OLMs move opposite each other during actuation (e.g., FIGS. 5 and 6, etc.), hinge elements 832 define an adjustment axis of 836 of armor element 808 about which armor element 808 can rotate into and out of the plane of the page (in FIG. 8A).

FIG. 8B is a cross-sectional view taken along line A-A of FIG. 8A showing endcap 814 attached to tray 810 with a fastener 840 (nut and bolt) disposed through apertures 826 and 828 (FIG. 8A). In some embodiments, the location(s) for fastener(s) 840 can be chosen to help mechanically position cassette 812 in tray 810. Endcap 814 has a "reverse C" cross-section and extends inward toward the center of tray 810 a distance sufficient to retain armor cassette 812 therein in tray 810 through the angular range of motion of tray 810. Optionally, a material (e.g., foam, spacer, etc.) can be inserted to fill any gap 842 between armor cassette 812 and endcap 814. In this embodiment, armor cassette 812 comprises a tri-plate having a symmetric configuration (e.g., as shown in FIG. 7A, etc.).

FIG. 8C is a cross-sectional view taken along line B-B of FIG. 8A showing the inboard wall 822 of tray 810 in greater detail. As shown, inboard wall 822 includes one or more openings formed therein. Here, inboard wall 822 includes a larger opening 850 and a smaller opening 852, which define keyways to receive keyed portions of armor cassette 812.

FIG. 8D shows armor cassette 812 in greater detail to include one or more keyed portions, which ensure that armor cassette 812 is loaded into tray 810 in a desired orientation. More specifically, keyed portions 860 and 862 of armor cassette 812 are sized to correspond with openings 850 and 852 of tray 810. Keyed portions 860 and 862 thus ensure, in this particular example, that the side of armor cassette 812 labeled "TOP" faces upward. This is desirable, for example, where an armor cassette 812 has an asymmetric tri-plate configuration (FIG. 7B) and an RHA layer having a particular thickness needs to face toward the open side of tray 810.

Armor cassette 812 also has indicia 864 printed thereon. Indicia 864 can indicate such information as the type (e.g., symmetric ERA, asymmetric ERA, armor only, etc.) of the cassette 812, the layer configuration (e.g., "RHA-Detasheet-RHA", etc.) of the cassette 812, and the thicknesses of the various layers (e.g., "0.25-0.25-0.25 inch", etc.). Such indicia 864 are useful where a plurality of armor cassettes 812 of different configurations are available, but where armor cassettes having are particular configuration need to be quickly identified and loaded into the trays 810 of an armor array already installed on vehicle 100.

Advantageously, an adaptable armor system including an array of armor elements 808 is readily adaptable to a variety of projectile threats, because armor cassettes 812 can be readily swapped out for different cassettes 812 having a desired configuration. Accordingly, the ability to respond and protect against a wide range of projectile threats can be quickly provided without having to remove and reinstall complete armor systems. Indeed, armor cassettes 812 can have any of the tri-plate configurations discussed previously herein (FIGS. 7A-7D), a different tri-plate configuration, or some other plate structure (e.g., one layer, two laminated layers, five laminated layers, etc.) as desired. Armor elements 808 can also be configured for and installed as armor elements (e.g., armor elements 108, 208, 508, etc.) in any of the adaptable armor systems described herein.

Figure 9:
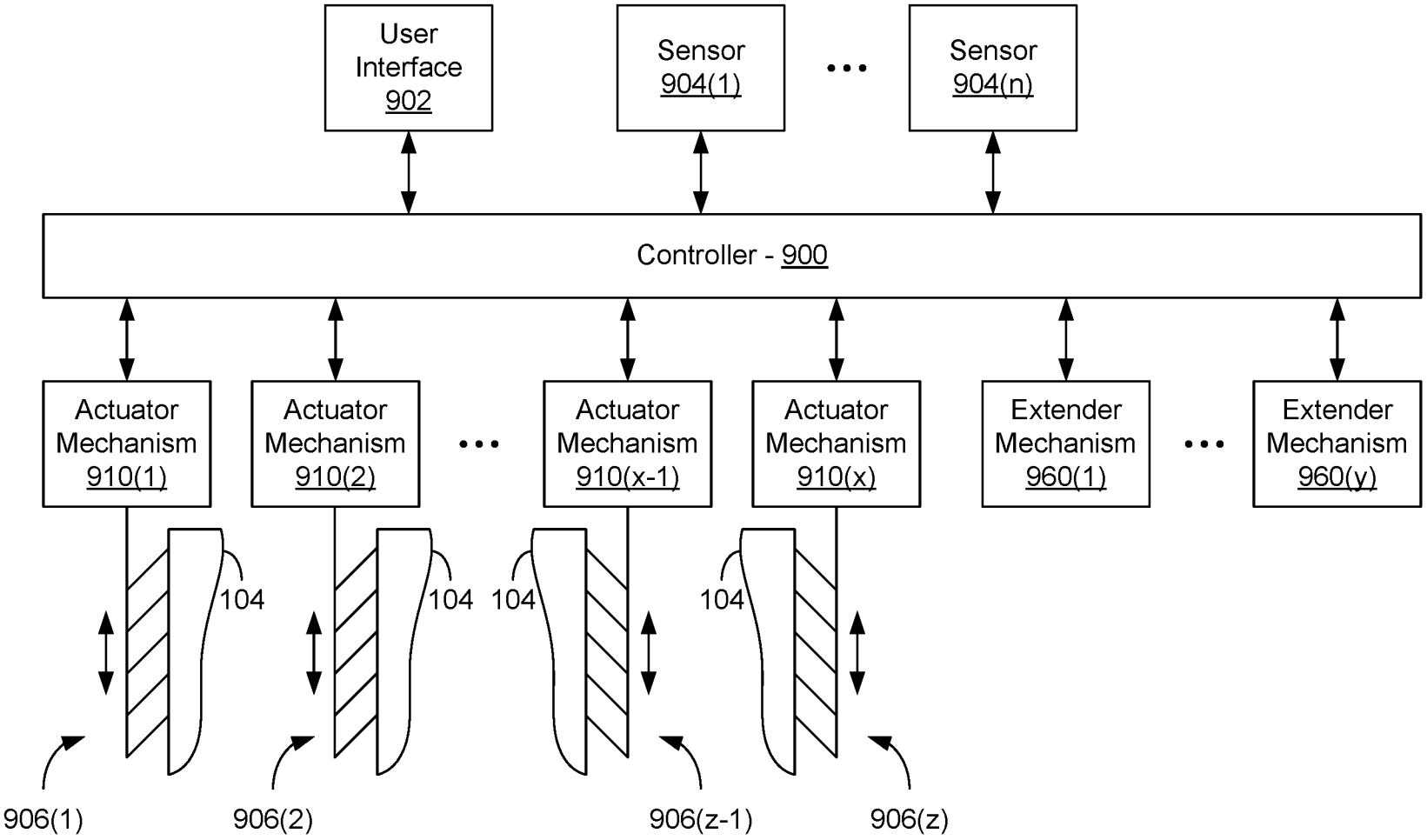
FIG. 9 is a block diagram showing a controller for an adaptive armor system according to an exemplary embodiment of the present invention.

FIG. 9 is a block diagram showing a controller 900 for controlling an adaptive armor systems according to an embodiment of the present invention. Controller 900 receives input from a user interface 902 and one or more sensors 904(1-*n*). Additionally, controller 900 is operatively connected to control one or more actuator mechanism 910 (1-*x*) (e.g., actuator mechanism 110, 510, etc.) and, optionally, one or more extender mechanisms 960(1-*y*) (e.g., extender mechanism 660, etc.). Controller 900 provides control signals to actuator mechanism(s) 910(1-*x*) to adjust the angular orientations of the armor elements of one or more associated armor arrays 906(1-*z*) in response to anticipated or incoming threat projectiles. The number of armor arrays 906(1-*z*) can equal the number of actuator mechanisms 910(1-*x*) or can be different. Controller 900 also provides control signals extender mechanisms 960(1-*y*) to selectively move armor arrays 906(1-*x*) away from or toward vehicle hull 104.

User interface 902 (e.g., mouse, keyboard, monitor, touch display, etc.) enables controller 900 to interface with one or more users, such as the vehicle of crew 100, maintenance personnel, etc. As one example, user interface 902 can enable an operator (not shown) to adjust the angular position of the armor array(s) 906 based on an expected threat by keying in a desired armor array angle. As another example, user interface 902 can enable an operator to input the configurations of the armor elements that are installed in the arrays 906 such that controller 900 can take this into account when responding to threats.

Sensor(s) 904(1-*n*) can incorporate any one or more of the types of threat detection sensors (e.g., RADAR, LIDAR, passive infra-red, optical, acoustic, etc.), whether now known or developed in the future, that are used in conjunction with active protection systems and projectile threat detection. In a preferred embodiment, controller 900 utilizes input from sensor(s) 904(1-*n*) to detect an approaching threat projectile, identify an approach attitude of the threat projectile, categorize the threat as to the type of warhead most likely employed, and control the appropriate ones of actuator mechanism(s) 910(1-*x*) to orient the plates of the appropriate armor array(s) 906 (e.g., whichever one(s) is/are likely to be struck by the approaching threat projectile) at optimum angle(s) to counteract the projectile. Controller 900 may be implemented as a stand-alone microprocessor-based computer device, as software on a multipurpose computer, etc.

It should be noted that, while controller 900 provides particular advantages, it is within the scope of the invention to employ manual (unpowered) angle adjustment system(s) and/or extender system(s) instead of the powered mechanism(s) 910(1-*x*) and 960(1-*y*). As one example, manual crank elements can be passed through the hull 104 of vehicle 100 such that the crew thereof could set armor angle(s) and/or extensions manually.

Figure 10:
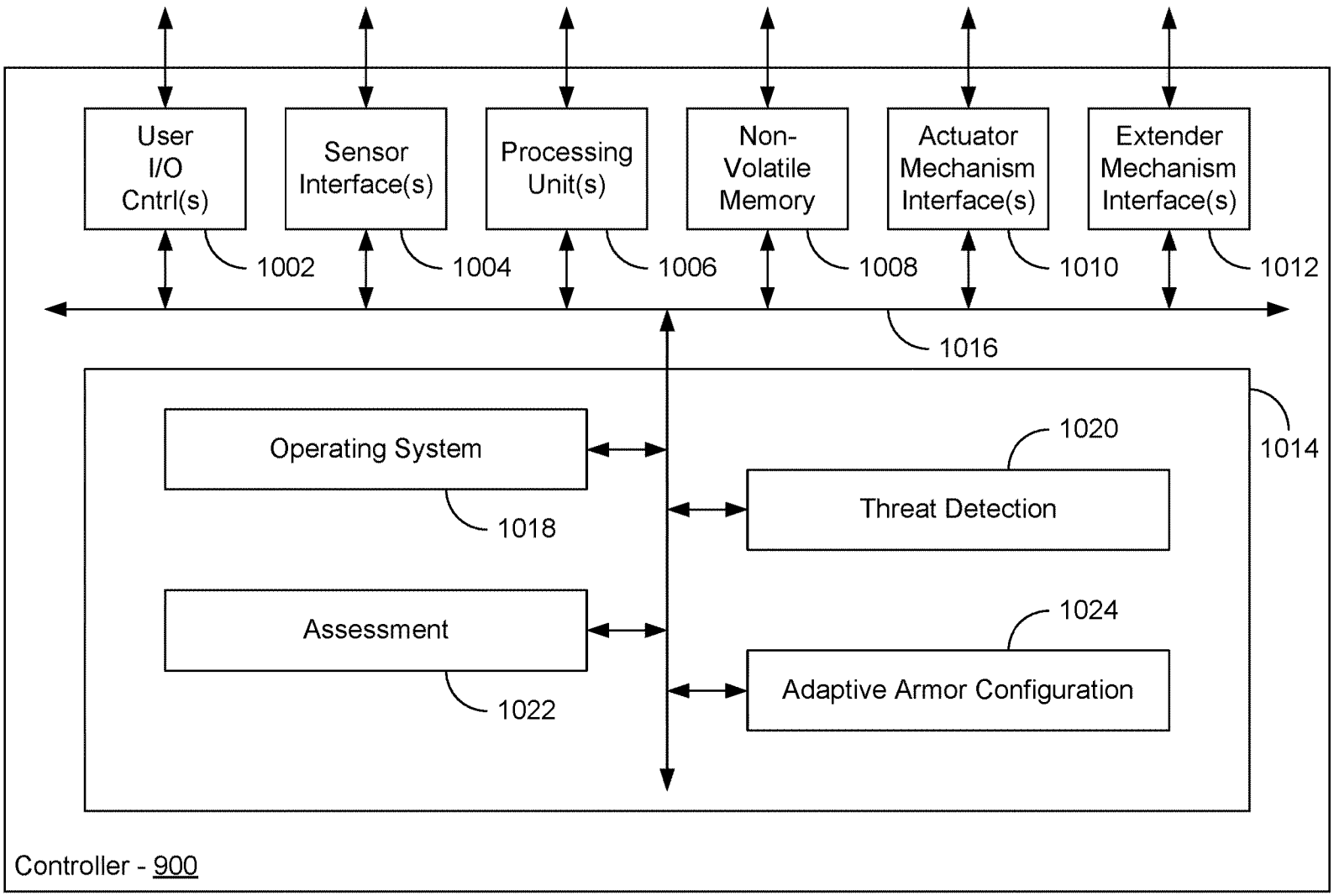
FIG. 10 is a block diagram showing the controller of FIG. 9 in greater detail.

FIG. 10 is a block diagram showing controller 900 in greater detail according to a particular embodiment of the present invention. Controller 900 includes one or more user I/O controller(s) 1002, one or more sensor interface(s) 1004, one or more processing unit(s) 1006, non-volatile memory 1008, one or more actuator mechanism interface(s) 1010, one or more extender mechanism interface(s) 1012, and working memory 1014 all intercommunicating via a system bus 1016.

The components of controller 900 provide the following functions. User I/O controller(s) 1002 manage connections and data transfer between controller 900 and user interface device(s) 902 that facilitate communication between controller 900 and operators. Sensor interface(s) provide communication interface(s) between controller 900 and sensors 904(1-*n*) such that controller 1002 can gather data about incoming threat projectiles. Processing unit(s) 1006 process data and code contained in working memory 1014 to cause controller 900 to carry out its intended functions. Non-volatile memory 1008 (e.g., solid-state memory, hard-disk drive, etc.) provides storage for data and code (e.g., boot code, operating system, threat detection algorithms, threat assessment algorithms, etc.) that are retained even when controller 900 is powered down. Actuator mechanism interface(s) 1010 facilitate communications between controller 900 and actuator mechanisms 910(1-*x*) such that the angular orientations of armor arrays 906 can be adjusted by controller 900. Similarly, extender mechanism interface(s) 1012 facilitate communications between controller 900 and extender mechanisms 960(1-*y*) such that controller 900 can adjust the distance between armor arrays 906 and vehicle hull 104. In some embodiments, sensor interfaces 1004, actuator mechanism interfaces 1010, and/or extender mechanism interfaces 1012 can comprise a common local area network (e.g., Ethernet, etc.) interface. System bus 1016 facilitates intercommunication between the various components/modules of controller 900.

Working memory 1014 (e.g., random access memory) provides dynamic memory for controller 900 and includes executable code that is loaded therein during initialization of controller 900. Working memory 1014 is shown to have loaded therein (e.g., from non-volatile memory 1008), an operating system 1018, a threat detection module 1020, an assessment module 1022, and an adaptive armor configuration module 1024. Operating system 1018 provides overall coordination and control of the functions provided by controller 900. Threat detection module 1020 is operative to detect an incoming threat projectile based on information received via sensor interface(s) 1004 and to provide an indication that an incoming threat has been detected. Assessment module 1022, responsive to the indication that an incoming threat has been detected and the sensor information, is operative to make at least one assessment of at least one characteristic specific to the incoming threat projectile. Such assessment(s) can include one or more of determining the likely type of incoming projectile (e.g., based on incoming velocity, etc.), determining an attitude of the incoming threat projectile, etc.

Adaptive armor configuration module 1024, responsive to the assessment(s), is operative to determine a desired angular orientation for the armor elements of one or more of the arrays 906. Further, module 1024 is operative to provide control signal(s) to actuator mechanism interface(s) 1010 associated with those array(s) 906 to change the angular orientation(s) of their armor elements toward the desired angular orientation in a manner to defeat the incoming threat projectile. Adaptive armor configuration module 1024 can determine a desired angular orientation for an array of armor elements based on various criteria, including the type of incoming threat projectile, the configuration(s) of the armor elements employed in array 906, the attitude of the incoming threat projectile (e.g., to account for projectiles coming in from above or below the armor array, etc.), a desired amount of interaction between the incoming threat projectile and the array of armor elements, etc.

Regarding adjusting the amount of interaction with the incoming threat projectile, recall that an incoming threat projectile (e.g., projectile 400 in FIG. 4A) travels on a trajectory and intersects an oblique armor element. In the case of an explosive reactive tri-plate (e.g., FIGS. 7A-7C), the threat-tri-plate impact initiates the explosive and a dynamic event occurs. During this event the threat projectile's mass continues to travel along its original trajectory colliding with the dynamic action of the tri-plate. More particularly, the oblique tri-plate layers separate and different portions of the diverging tri-plates interact with different portions of the incoming threat projectile at different times.

Different tri-plate obliquities and mass arrangements have different interactions with the threat mass, trajectory, and velocity. Shallower obliquities (e.g., FIG. 4A) have rapid interactions and durations with the projectile's trajectory, whereas steeper obliquities (FIG. 4B) have prolonged interactions and durations with the threat trajectory. Hence, faster shorter threats are more suitable for shallow tri-plate obliquities, whereas slower or longer threats are more suitable for steeper tri-plate obliquities. A steep tri-plate obliquitiy would typically have minimal plate-mass interaction with a shorter faster threat. A shallow tri-plate obliquity would typically have significant plate interaction with the early particles of a slower elongated threat (e.g., an EFP), but may miss slower tail end particles.

FIG. 11A shows an exemplary time coincidence look-up table (LUT) 1100 of the type that can be employed by adaptive armor configuration module 1024 to determine a desirable angular orientation for an array 906 based on time coincidence. Column 1102 indicates the configuration type of different exemplary tri-plates (symmetrical—e.g., FIG. 7A; asymmetrical—e.g., FIG. 7B) and the exemplary projectile types (EFP or SCJ) to be encountered. ("Asymmetrical Front Plate" indicates a thicker front (top) plate, whereas "Asymmetrical Rear Plate" indicates a thicker rear (bottom) plate.) The remaining columns 1104 indicate the time coincidence percentage for different tri-plate obliquities relative to a horizontal threat projectile (FIG. 4A). The values given in the table are exemplary and will change based on type of projectile threat, tri-plate configuration and outward velocities, etc.

A coincidental time percentage less than 100% indicates that the dynamic tri-plates moved faster than the given threat and portions of the threat were not necessarily affected by the reactive armor. A value over 100% indicates that the dynamic tri-plates had equivalent or greater coincidence with the threat. 200% would indicate that tri-plates had twice as much needed coincidence time with the threat. In a particular embodiment, it is desirable to position the armor elements of an array at an angle to yield at least (100%) coincidence (play time) with the threat, and at most four times the play time (400%). At less than 100% time coincidence, significant portions of the threat are not being interacted by the reactive armor. Any more time than 400%, and minimal reactive armor mass is interacting the threat. Based on the exemplary data in table 1100, 20°-60° offer good obliquities for the shorter, faster SCJ-type threats, whereas obliquities of 45°-75° are better for the slower, elongated EFP-type threats from a "coincidence time" perspective.

One aspect to note is the time coincidence of asymmetrical tri-plates. Asymmetrical tri-plates offer a means to create tri-plate dynamics that can be both fast and slow. The lighter plate, having a high velocity, can be used to disrupt faster moving early particles of an SCJ threat. The heavier plate, with a slower velocity, can be used to disrupt slow particles that lag behind the faster lead particles. Asymmetrical tri-plates provide a robust approach to dealing with variable particle speeds in a threat scenario.

Mass coincidence is another factor that can be utilized by adaptive armor configuration module 1024. Mass coincidence takes the tri-plate mass interacting with the total threat mass and gives a percentage based on the obliquity of interest. However, generally, mass coincidence is more difficult to analyze because threats will different masses. Therefore coincidental mass percentages can show some disparity.

Exemplary mass coincidence values for exemplary SJC-type threats and EFP-type threats are provided in table 1150 shown in FIG. 11B. For the lighter SCJ-type threat, good mass coincidence obliquity (higher relative percentage) is obtained in a range from around 15°-45°. For the heavier EFP-type threat, larger mass coincidence occurs in the 15° and 30° obliquity range. While more of the reactive armor mass is in play, EFP threats are often segmented into a sequence of slugs. The 15°-30° range of obliquity shows a flat/level trend for the EFP-type threat because the dynamic tri-plates had placed their complete mass in the trajectory of the threat. Comparing this with the time coincidence table 1100, however, it becomes evident that portions of the EFP threat would be missed by the dynamic tri-plates in the 15°-30° range (time coincidence <100%), and a better obliquity range for the exemplary EFP-type threat is 45°-60°.

This characterization approach shows that there are zones of angular optimality of reactive armor for given threat types. In the examples above, for slower, elongated EFP-type threats, armor effectiveness is better in the 45°-75° range of obliquity. For the faster, shorter SCJ-type threats, armor effectiveness is better in the obliquity range of 15°-45°. This shows that the adaptable armor system of the present invention provides enhanced performance and threat response by having the ability to change the obliquity of its armor elements on demand. This ability also eliminates the parasitic weight and capacity that would otherwise be required in an armor design that covers the different ranges of threats. This characterization also shows that having the ability to readily change or modify the armor cassette composition (mass, dimensions, explosives, layers, etc.) provides additional adaptability to accommodate the multitude of current and emerging threat types in different theaters.

Thus, module 1024 is able to determine an optimum angular orientation for some or all of an array of armor elements based on one or more of the type of incoming threat projectile (e.g., EFP, SCJ, etc.), the configurations (e.g., tri-plate configurations, etc.) of the installed armor elements, the attitude of the incoming threat projectile, a desired amount of time coincidence between the armor and projectile, a desired amount of mass coincidence between the armor and projectile, etc., for example, by utilizing LUTs similar to those in FIGS. 11A and 11B that are specific to the types of projectiles likely to be encountered. As another example (e.g., in the case of limited reaction time, etc.) module 1024 can adjust the orientation of the armor elements toward target ranges based only on projectile type and/or attitude, where the target ranges are those predetermined to be most effective against the particular projectile types likely to be encountered (e.g., using a similar analysis as described above).

Figure 12:
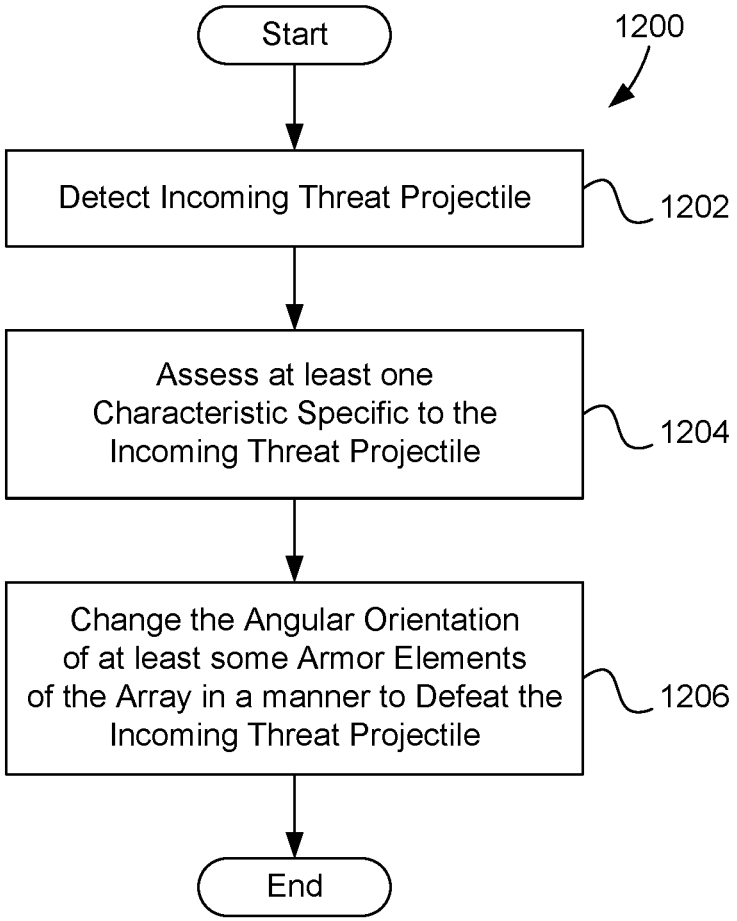
FIG. 12 is a flowchart summarizing an exemplary method for controlling an adaptive armor system according to the present invention.

FIG. 12 is a flowchart summarizing a method for controlling an adaptive armor system having an array of armor elements positioned alongside an exterior surface of a vehicle where the angular orientation of each of the armor elements is adjustable. In a first step 1202, an incoming threat projectile is detected. In a second step, at least one characteristic (e.g., type of projectile, attitude, etc.) specific to the incoming threat projectile is assessed. In a third step, an angular orientation of at least some of the armor elements of the array is changed in a manner to defeat the incoming threat projectile (e.g., based on type of projectile, armor configuration, attitude, time and/or mass coincidence, etc.).

The adaptive armor systems disclosed herein may, with modifications that will be obvious to a person of skill in the pertinent art, be adapted and mounted to a vehicle to protect the front, rear, or any lateral surface thereof, so long as the vehicle configuration (surface contours/angles, hatch/door opening, etc.) make such use practical. Further, the present invention may be utilized to protect any vertical or near-vertical (i.e., relatively gently sloping) vehicle surface where the mass of the armor array provides a downward vector (due to gravity) having a magnitude sufficient to ensure that the flexible components of the system (those portions unable to support significant compressive loads) remain sufficiently loaded and in proper alignment during operation.

While exemplary embodiments are described above, it is not intended that these embodiments describe all possible forms of the invention. Rather, the words used in the specification are words of description rather than limitation, and it is understood that various changes may be made without departing from the spirit and scope of the invention. For example, the actuator mechanisms described herein can be mounted at any appropriate location (internal or external to the vehicle) which permits mechanical linkage between the actuator and the array. Additionally, the features of various implementing embodiments may be combined to form further embodiments of the invention.

What is claimed is:

1. An adaptive armor system comprising:

a plurality of armor elements, each of said plurality of armor elements having an inboard edge and an outboard edge opposite said inboard edge;

a hinge system configured to couple to each of said plurality of armor elements, to position said inboard edge of each of said plurality of armor elements external to a body of a vehicle such that respective inboard edges of said plurality of said armor elements are closer to said body than respective outboard edges, and to permit rotation of each of said plurality of armor elements about a respective axis to change its angular orientation with respect to said body;

an actuator mechanism; and a tension support configured to movably couple between said actuator mechanism and said at least one armor element such that said tension support bears at least a portion of the weight of each of said plurality of armor elements in tension; and wherein said actuator mechanism is configured to move said tension support to cause each of said plurality of armor elements to rotate about said respective axis;

said hinge system comprises at least one outboard linking member and at least one inboard linking member each configured to pivotally couple said plurality of armor elements, said inboard linking member configured to pivotally couple said plurality of armor elements at a location closer to said body of said vehicle than said outboard linking member;

said tension support comprises a flexible suspension member having a first end coupled to said outboard linking member and a second end coupled to said inboard linking member; and said actuator mechanism comprises a drive wheel configured to engage said flexible suspension member such that rotation of said drive wheel in a first direction simultaneously raises said outboard linking member and lowers said inboard linking member, and rotation of said drive wheel in a second direction simultaneously lowers said outboard linking member and raises said inboard linking member.

2. The adaptive armor system of claim 1, wherein said armor element comprises:

an armor cassette; and a tray configured to removably receive said armor cassette.

3. The adaptive armor system of claim 2, wherein said armor cassette comprises an explosive.

4. The adaptive armor system of claim 2, further comprising:

a first armor cassette having a first layered configuration comprising explosive and a plurality of metal plates;

a second armor cassette having a second layered configuration comprising explosive and a plurality of metal plates, said second layered configuration being different than said first layered configuration; and a third armor cassette having a third configuration different than said first and said second layered configurations; and wherein said tray is configured to selectively receive any one of said first, said second, and said third armor cassettes therein.

5. The adaptive armor system of claim 2, wherein said tray comprises a release mechanism configured to releasably retain said armor cassette in said tray.

6. The adaptive armor system of claim 2, wherein said tray comprises at least one keyway configured to receive a complementary keyed portion of said armor cassette.

7. The adaptive armor system of claim 1, wherein at least one of said outboard linking member and said inboard linking member comprises an elongated flexible structure.

8. The adaptive armor system of claim 1, wherein said tension support and at least one of said outboard linking member and said inboard linking member comprise a continuous flexible structure.

9. The adaptive armor system of claim 1, further comprising a controller operative to:

detect an incoming threat projectile;

assess at least one characteristic specific to said threat projectile; and activate said actuator mechanism in response to said assessed characteristic of said threat projectile to change said angular orientation of said plurality of armor elements in a manner to defeat said threat projectile.

10. The adaptive armor system of claim 1, further comprising an extender mechanism configured to selectively move said plurality of armor elements and at least a portion of said hinge system away from said body of said vehicle.

11. The adaptive armor system of claim 1, wherein said tension support comprises a chain.

12. An adaptive armor system comprising:

a plurality of armor elements, each of said plurality of armor elements having an inboard edge and an outboard edge opposite said inboard edge;

a hinge system configured to couple to each of said plurality of armor elements, to position said inboard edge of each of said plurality of armor elements external to a body of a vehicle such that respective inboard edges of said plurality of said armor elements are closer to said body than respective outboard edges, and to permit rotation of each of said plurality of armor elements about a respective axis to change its angular orientation with respect to said body;

an actuator mechanism; and a tension support configured to movably couple between said actuator mechanism and at least one of said plurality of armor elements such that said tension support bears at least a portion of the weight of each of said plurality of armor elements in tension; and wherein said actuator mechanism is configured to move said tension support to cause each of said plurality of armor elements to rotate about said respective axis;

said hinge system comprises at least one outboard linking member and at least one inboard linking member each configured to pivotally couple said plurality of armor elements, said inboard linking member configured to pivotally couple said plurality of armor elements at a location closer to said body of said vehicle than said outboard linking member; and said tension support and at least one of said outboard linking member and said inboard linking member comprise a continuous flexible structure.

13. The adaptive armor system of claim 12, wherein said armor element comprises:

an armor cassette; and a tray configured to removably receive said armor cassette.

14. The adaptive armor system of claim 13, wherein said armor cassette comprises an explosive.

15. The adaptive armor system of claim 13, wherein said tray comprises a release mechanism configured to releasably retain said armor cassette in said tray.

16. The adaptive armor system of claim 13, further comprising:

a first armor cassette having a first layered configuration comprising explosive and a plurality of metal plates;

a second armor cassette having a second layered configuration comprising explosive and a plurality of metal plates, said second layered configuration being different than said first layered configuration; and a third armor cassette having a third configuration different than said first and said second layered configurations; and wherein said tray is configured to selectively receive any one of said first, said second, and said third armor cassettes therein.

17. The adaptive armor system of claim 13, wherein said tray comprises at least one keyway configured to receive a complementary keyed portion of said armor cassette.

18. The adaptive armor system of claim 12, wherein the other of said outboard linking member and said inboard linking member comprises an elongated flexible structure.

19. The adaptive armor system of claim 12, further comprising a controller operative to:

detect an incoming threat projectile;

assess at least one characteristic specific to said threat projectile; and activate said actuator mechanism in response to said assessed characteristic of said threat projectile to change said angular orientation of said plurality of armor elements in a manner to defeat said threat projectile.

20. The adaptive armor system of claim 12, further comprising an extender mechanism configured to selectively move said plurality of armor elements and at least a portion of said hinge system away from said body of said vehicle.

* * * * *